US005507442A

United States Patent [19]

Konno et al.

[11] Patent Number: 5,507,442

[45] Date of Patent: Apr. 16, 1996

[54] METHOD AND APPARATUS FOR WINDING TOROIDAL COILS

[75] Inventors: Toshio Konno; Kazuhiro Sugai; Shinya Watanabe; Hiroyuki Konno; Tooru Shoji, all of Miyagi, Japan

[73] Assignee: Tokin Corporation, Miyagi, Japan

[21] Appl. No.: 119,365

[22] Filed: Sep. 9, 1993

[30] Foreign Application Priority Data

| | | | |
|---|---|---|---|
| Sep. 10, 1992 | [JP] | Japan | 4-241881 |
| Oct. 29, 1992 | [JP] | Japan | 4-316370 |
| Nov. 9, 1992 | [JP] | Japan | 4-324932 |
| May 31, 1993 | [JP] | Japan | 5-154152 |

[51] Int. Cl.[6] ..... B65H 81/02

[52] U.S. Cl. ..... 242/4 R; 242/4 C; 29/605

[58] Field of Search ..... 242/4 R, 4 C; 29/605

[56] References Cited

U.S. PATENT DOCUMENTS

| | | | |
|---|---|---|---|
| 2,444,126 | 6/1948 | Wirth | 242/4 C |
| 3,128,955 | 4/1964 | Stutz | 242/4 R |
| 3,799,462 | 3/1974 | Fahrbach | 242/4 C |
| 4,694,999 | 9/1987 | Ishida et al. | 242/4 R |
| 4,988,047 | 1/1991 | Kariya et al. | 242/4 R |
| 5,086,983 | 2/1992 | Darrieux | 242/4 R |

FOREIGN PATENT DOCUMENTS

| | | | |
|---|---|---|---|
| 132843 | 2/1985 | European Pat. Off. . | |
| 206112 | 12/1983 | Japan | 242/4 R |
| 285707 | 12/1986 | Japan | 242/4 R |

*Primary Examiner*—Daniel P. Stodola
*Assistant Examiner*—Michael R. Mansen
*Attorney, Agent, or Firm*—Hopgood, Calimafde, Kalil & Judlowe

[57] ABSTRACT

In a method for winding a toroidal coil, a winding of a first layer is made by means of repeating the following three steps. At a first step, one end of a wire is inserted into a central aperture of a core from one side thereof to extend the wire along an axial direction of the core; the other end of the wire is abutted to one surface of the core such that the other end is radially extended; and a tension is applied to the wire and the core with the other end of the wire is then turned in a diametrical direction of the core perpendicular to the radial direction. At a second step, the one end of the wire is inserted into the central aperture of the core towards the other side; and the tension is applied to the wire and the core is then rotated at a desired angle in one direction on a central axis of the core. At a third step, the core is grasped again by core turning means to turn the core in the same direction; the one end of the wire is inserted into the central aperture of the core towards the one side thereof, the one end being extended and the tension being applied to the wire, and then the core is rotated using the core turning means to shift it back at the desired angle in the other direction opposite to the one direction.

6 Claims, 16 Drawing Sheets

METHOD AND APPARATUS FOR WINDING TOROIDAL COILS

BACKGROUND OF THE INVENTION

This invention relates to a method and apparatus for automatically winding toroidal coils and, in particular, to a method and apparatus for automatically winding a length of wire on a ring-shaped core, with the wire passing through a central aperture of the core. As used herein, the term "ring-shaped core" means an article having a closed curve cross-section of a toroid such as a toroidal core or any one of hollow cross-sections.

Methods for winding toroidal coils with a conventional automatic winding machine come into three general categories described below.

In the first method, three rollers are abutted to the peripheral surface of a core to support it rotatably and the wire of a predetermined length is contained within a shuttle in a winding machine. The shuttle carrying a length of wire travels through the central aperture of the core and the wire is drawn out of the shuttle through an opening provided in it. This method is, however, time consuming and ineffective due to the necessity of preparing the wire within the shuttle. In addition, the wire may be rubbed against the periphery of the opening. This may result in some damages on an insulating layer of the wire. Another disadvantage is that the shuttle passes through the central aperture of the core, which restricts the application of it only to relatively large cores. Furthermore, smooth rotation of the core becomes more difficult as the winding proceeds and thus this method sometimes has a trouble in lap winding of the wire.

The second method is directed to a hook-winding of the wire, in which two steps are repeated: to pass the wire of a predetermined length over a surface of the core at one side thereof and to catch the wire with a hook extending from the other side of the core through the central aperture thereof. This method is seriously disadvantageous in that the wire is rubbed against the hook, causing an insulating layer to be damaged.

On the other hand, the third method provides a shuttleless winding machine that requires no hook as well. Instead, the third method requires multiple turning of the core. One end (leading end) of the wire is passed through the central aperture of the core and is extended in the core axial direction. The core is then turned through 180° on a diametrical axis thereof together with the other end (tailing end) of the wire. This turn allows the wire to be laid on the outer periphery of the core. Subsequently, the leading end is again passed through the central aperture to lay the wire on the inner periphery of the core and thus one loop is wound about the core. These steps are repeated until enough wire is wound into a coil. In this event, the core is rotated about its axis by a winding pitch before each turn or reverse through 180°. This rotation is achieved using a pair of core turning clamps. The core turning clamps hold less than the respective halves of the core at the opposing sides thereof and are capable of turning the core in one direction on the diametrical axis thereof. The rotation axes of the core turning clamps cross each other at an angle of the winding pitch. Accordingly, movement of the core turning clamps results in rotation of the core by the winding pitch.

In this method, lap winding can be made by changing the cross angle of the core turning clamps from plus to minus or vice versa. Such rotation which relies on changing the holding position may create a problem, especially when each clamp holds the core being covered with the first layer of the wire upon lap winding. Thus, this method is also disadvantageous because of potential problems which may occur in the subsequent winding.

SUMMARY OF THE INVENTION

Accordingly, an object of the present invention is to provide a method and an apparatus for winding toroidal coils by means of which it is possible to produce a lap winding with high reliability by improving the process for turning a core followed by passing a length of wire through a central aperture of the core and applying tension to the wire.

Another object of the present invention is to provide an automatic winding machine capable of rotating a toroidal core in the circumferential direction to shift the winding position of the wire to be wound, thereby avoiding irregular winding of the wire.

According to a first embodiment of the invention, a method is provided for winding a toroidal coil comprising the steps of (a) inserting one end of a wire having a predetermined length into a central aperture of a core from one side thereof to extend the wire along an axial direction of the core; abutting the other end of the wire to one surface of the core such that the other end is radially extended at a predetermined length; applying a tension to the wire and then turning the core with the other end of the wire by using core turning means on a diametrical direction of the core perpendicular to the radial direction, thereby laying the wire on the other surface of the core and an external periphery thereof; (b) inserting the one end of the wire into the central aperture of the core towards the other side; applying the tension to the wire and then rotating the core at a desired angle, by using core rotating means independent of said turning means, in one direction on a central axis of the core; (c) grasping again the core with said core turning means to turn the core in the same direction; inserting the one end of the wire into the central aperture of the core towards the one side, the one end being extended and the tension being applied to the wire, and then rotating the core using said core turning means to shift it back at the desired angle in the other direction opposite to the one direction; (d) repeatedly carrying out the steps (a) through (c) to form an odd layer of the winding; (e) grasping again the core with said core turning means to turn the core in the same direction; inserting the one end of the wire into the central aperture of the core towards the other side, the one end being extended and the tension being applied to the wire, and then rotating the core at the desired angle, by using said core turning means, in the other direction; (f) grasping again the core with said core turning means to turn the core in the same direction; inserting the one end of the wire into the central aperture of the core towards the one side, the one end being extended and the tension being applied to the wire, and then rotating the core using said core turning means to rotate the core at the desired angle in the one direction; and (g) repeatedly carrying out the steps (e) and (f) to form an even layer of the winding.

According to a second embodiment of the invention, a method is provided for controlling a tension applied to a wire wound in a toroidal coil winding machine of an upright type comprising the steps of (a) passing an end of a wire of a predetermined length supported at both sides into a central aperture of a toroidal core; (b) pulling the end of the wire passed through the central aperture of the toroidal core in the direction of a central axis of the toroidal core; (c) applying a predetermined tension to the wire to lay the wire on an external periphery of the toroidal core by means of turning the toroidal core on a central axis along the diametrical direction thereof; and (d) repeatedly carrying out the steps (a) through (c) to wind the wire on the toroidal core, whereby the tension applied to the wire is controlled a constant amount to wind the wire on the core through a two-stage operation of a high-speed coarse positioning and a position detection, the high-speed coarse positioning being achieved by a servo-motor according to a predetermined length of wire to be wound on the core, the position detection being achieved by a combination of an extension spring of a wire chuck holder that advances in response to pulses of the wire chuck holder holding the end of the wire; shutter members integrally formed with a pull chuck mounted on the wire chuck holder; and tension detectors disposed on the wire chuck holder in an opposite direction to the respective shutter members.

According to a third embodiment of the invention, winding machine is provided for winding a length of wire on a toroidal core comprising a turning clamp portion for holding the core together with one end of the wire as well as for turning the core upside-down; a feed clamp portion for holding the core and adapted to travel along a circular guide rail on the axis of the core and to turn the core circumferentially; and a wire chuck assembly for inserting the other end of the wire into a central aperture of the core and for applying a predetermined tension to the wire to wind the wire on the core through a combination of a turning operation and a rotating operation to the core, whereby turning of the core is made independent of rotation of the core.

According to a fourth embodiment of the invention, an apparatus is provided for controlling tension applied to a wire wound in a toroidal coil winding machine of an upright type, said apparatus comprising a servo-motor mounted at a top of a longitudinal guide rail disposed longitudinally in an upwardly direction; a belt driven by said servo-motor; a wire chuck holder cooperatively associated with said belt; and a core clamp assembly positioned at half the height of said guide rail, whereby a wire is capable of being wound on a toroidal core by employing the steps of, grasping the toroidal core with said core clamp supported horizontally, turning the toroidal core on an axis along the diameter thereof; rotating the toroidal core on the center of the core including the diameter thereof; inserting one end of the wire into a central aperture of the core from an upward to downward direction or vice versa; and pulling the wire alternatively in the up-and-down direction, said apparatus further employing a wire chuck holder having a slidable pull chuck for high-speed positioning with the servo-motor along the guide rail in the up-and-down direction. An insertion chuck is employed, wherein the wire chuck holder is capable of being turned and reciprocated for alternatively pulling one end of the wire upward and downward. An extension spring is so disposed as to connect the pull chuck and the wire chuck holder at the head of the wire chuck holder. In addition, two shutter members are employed, projecting from the insertion chuck at the opposite side of an extension spring and the pull chuck, the shutter members being different in length from each other. Two tension detectors are connected to the shutter members disposed on the wire chuck holder.

BRIEF DESCRIPTION OF THE DRAWING

FIGS. 12A and 12B are views showing the structure of an automatic toroidal coil winding machine according to another embodiment of the present invention, in which FIG. 12A and FIG. 12B are plan and side views, respectively, thereof;

DESCRIPTION OF THE PREFERRED EMBODIMENT

Figure 1:
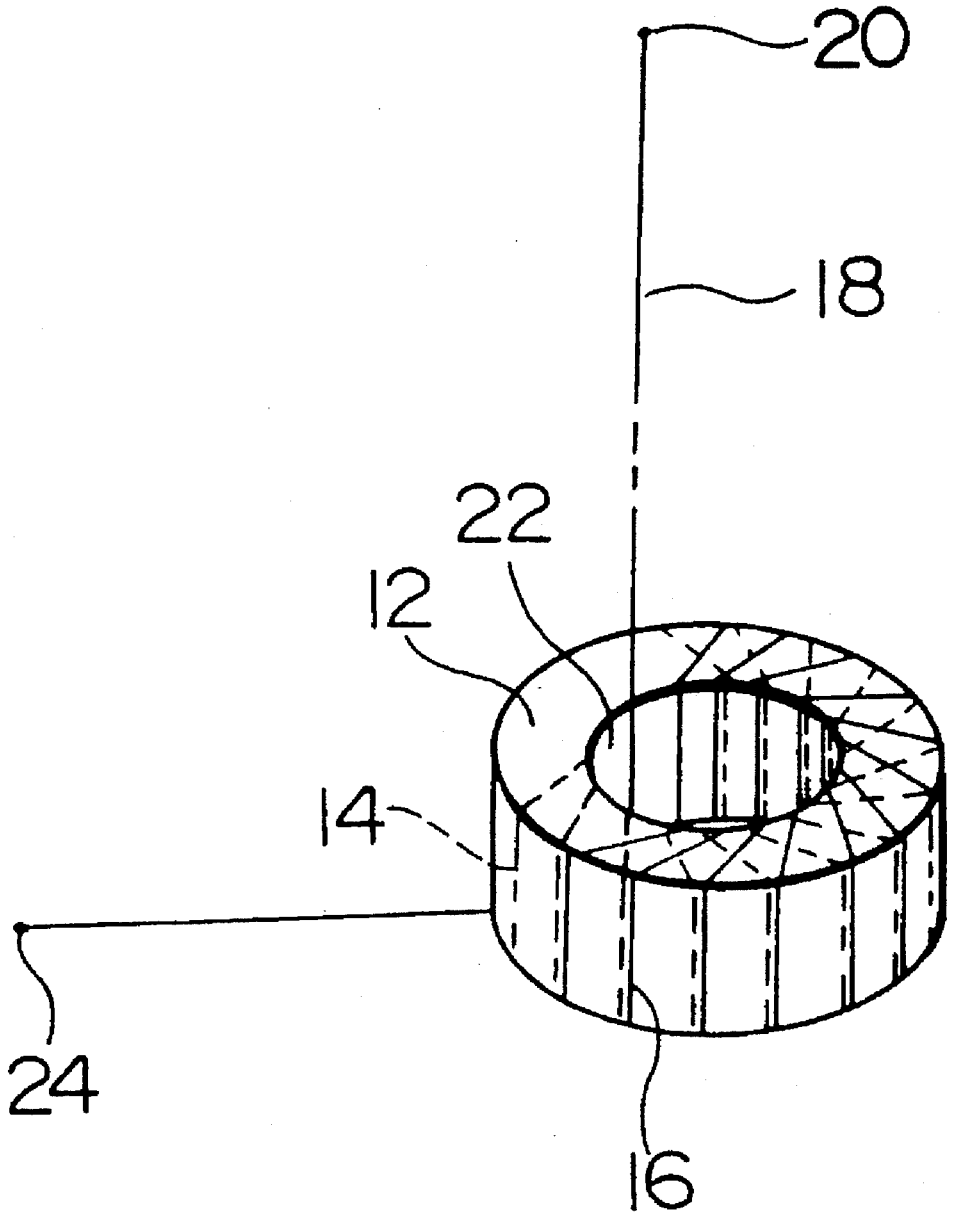
FIG. 1 is a schematic rendition of a toroidal coil where a length of wire is wound in double-layer according to a method of the present invention.

An embodiment of the present invention will be described with reference to the drawing. Throughout the following detailed description, similar reference numerals refer to similar elements in all figures of the drawing.

FIG. 1 is a schematic of a toroidal coil where a length of wire is wound in double-layer according to a method of the present invention. In FIG. 1, the first and second layers of the wire wound on a core 12 is depicted by a broken line 14 and a solid line 16, respectively. One end (leading end) 20 of the wire is passed through a central aperture 22 of the core 12. The other end (tailing end) 24 is radially outwardly extended beyond the core and is turned along with the core 12.

As will be noted from FIG. 1, core 12 is characterized by a periphered surface around which the wire is wound and an annular surface on each side of the core.

Figure 2:
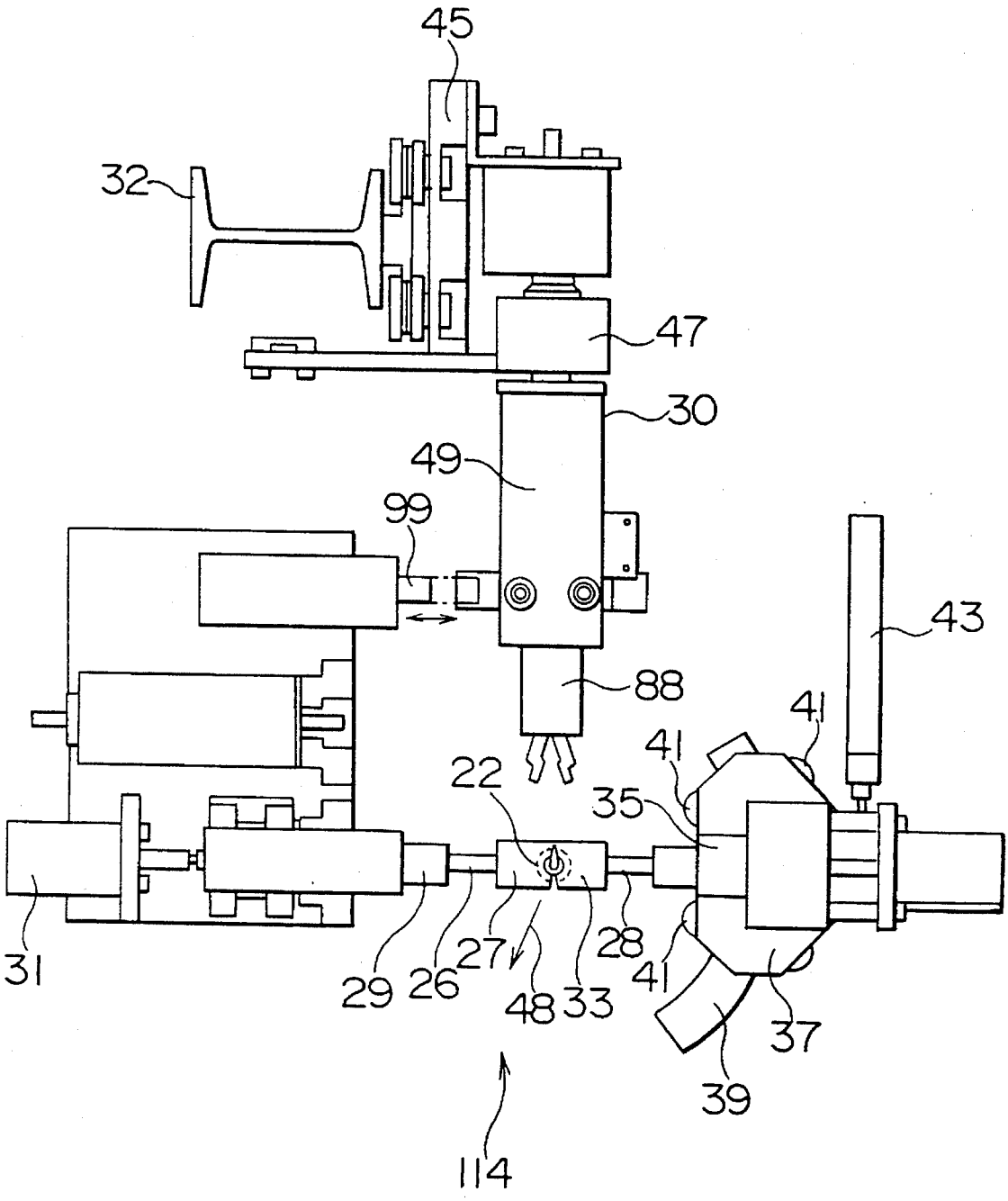
FIG. 2 is a plan view showing an essential part of an automatic winding machine for use in carrying out the method of the present invention.

An essential part of an automatic winding machine used for implementing the present invention is shown in a plan view in FIG. 2. In FIG. 2, a core turning clamp 26 and a core rotating clamp 28 are aligned horizontally (parallel to the surface of the figure) in an opposed relation. A wire chuck assembly 30 is disposed transversely to the core turning clamp 26 and the core rotating clamp 28. A guide rail 32 is positioned longitudinally and vertically (perpendicular to the surface of the figure) to guide the wire chuck assembly 30. In other words, the wire chuck assembly 30 moves upward and downward along the guide rail 32. The core turning clamp 26 and the core rotating clamp 28 are positioned horizontally at approximately half the height of the guide rail 32. The core turning clamp 26 comprises a claw portion 27, an air cylinder 29 and a rotating device 31. The claw portion 27 is located at the tip of the core turning clamp 26. The air cylinder 29 works to advance the tip claw portion 27 (towards the right side of the figure) to close the same. It also works to retract the tip claw portion 27 (toward the left side of the figure) to open the same. The rotating device 31 rotates the tip claw portion 27 about a horizontal axis in one direction.

On the other hand, the core rotating clamp 28 comprises a tip claw portion 33, an air cylinder 35, a mounting plate 37 and a circular rail 39. The claw portion 33 is located at the tip of the core rotating clamp 28. The air cylinder 35 works to advance the tip claw portion 33 (towards the left side of the figure) to close the same. It also works to retract the tip claw portion 33 (toward the right side of the figure) to open the same. The air cylinder 35 is fixed to the mounting plate 37 which moves along the circular rail 39. The circular rail 39 forms a part of the circumference of a circle centered on the central axis (not shown; perpendicular to the surface of FIG. 2) of the core 12 held by the tip claw portion 33. The mounting plate 37 is supported by four rollers 41 along the circular rail 39 so as to be moved rightward and leftward. An air cylinder 43 contributes to move the mounting plate 37 towards the right and left, which results in rotation of the clamped core 12 on the central axis thereof.

The wire chuck assembly 30 comprises a wire chuck holder 49 attached to a shaft of a reciprocating reverse mechanism 47. The reciprocating reverse mechanism 47 is fixed to a base 45. The base 45 slides upward and downward on the elongated vertical guide rail 32.

Figure 3:
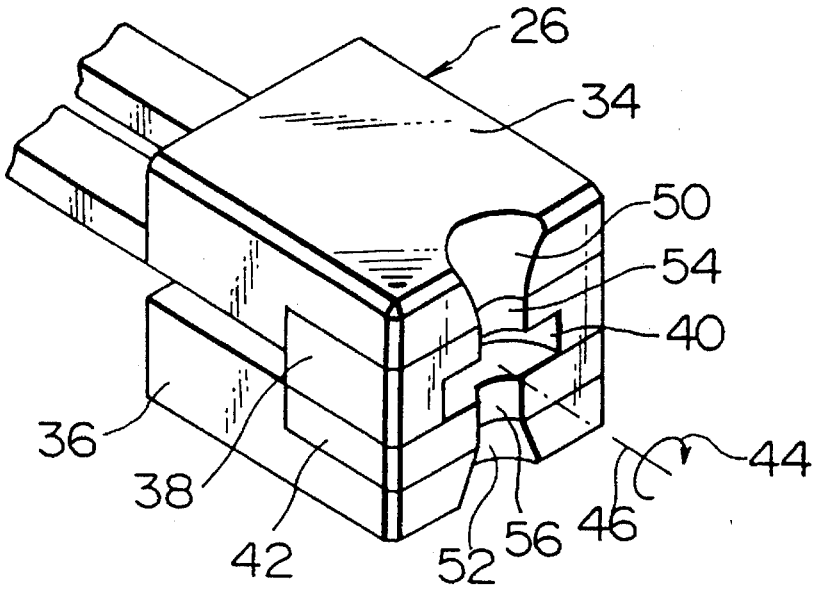
FIG. 3 is a perspective view showing the structure of a tip claw portion of a core turning clamp illustrated in FIG. 2.

The claw portion at the tip of the core turning clamp 26 comprises, as shown in FIG. 3, a pair of grasp claws 34 and 36 that moves from left to right in FIG. 2. Urethane rubbers 38 and 42 are attached to the grasp claws 34 and 36, respectively, to hold or grasp a part of the core 12. More particularly, a concave portion 40 is formed in the urethane rubber 38 and the core 12 is pinched between the concave portion and a flat surface of the urethane rubber 42. The rotating device 31 rotates the core turning clamp 26 over 180° in one direction (clockwise), as depicted by an arrow 44, on a rotation axis 46 parallel to the diameter of the core 12. As a result, the core 12 is reversed. The grasp claws 34 and 36 are separated from each other and opened to release the core 12 when the core turning clamp 26 is withdrawn to the left. The concave portion 40 is equal in width to the core 12 and has semi-circular upper and lower surfaces. The semi-circular surfaces are slightly smaller than the half of the core 12. The core turning clamp 26 grasps a part of the core 12 inserted into the concave portion 40. In this event, the tailing end 24 of the wire 18 is held between the flat surfaces of the urethane rubbers 38 and 42. More particularly, the tailing end 24 remains straight to be held in the radial direction of the core 12 depicted by an arrow 48 in FIG. 2. The core 12 is thus turned with the tailing end 24 being held between the urethane rubbers 38 and 42. Longitudinal slots 50 and 52 are formed in the grasp claw 34 and 36, respectively, to facilitate insertion of the leading end 20 of the wire into the center of the claw tip portions. Each of the longitudinal slots 50 and 52 is formed into a half-conical shape. The urethane rubbers 38 and 42 are provided with semi-circular notches 54 and 56, respectively. The notch 54 communicates with the slot 50 while the notch 56 is communicated with the slot 52. In addition, the semi-circular notches 54 and 56 communicate with the central aperture 22 of the core 12 when a part of it is laid on and held by the concave portion 40.

Figure 4:
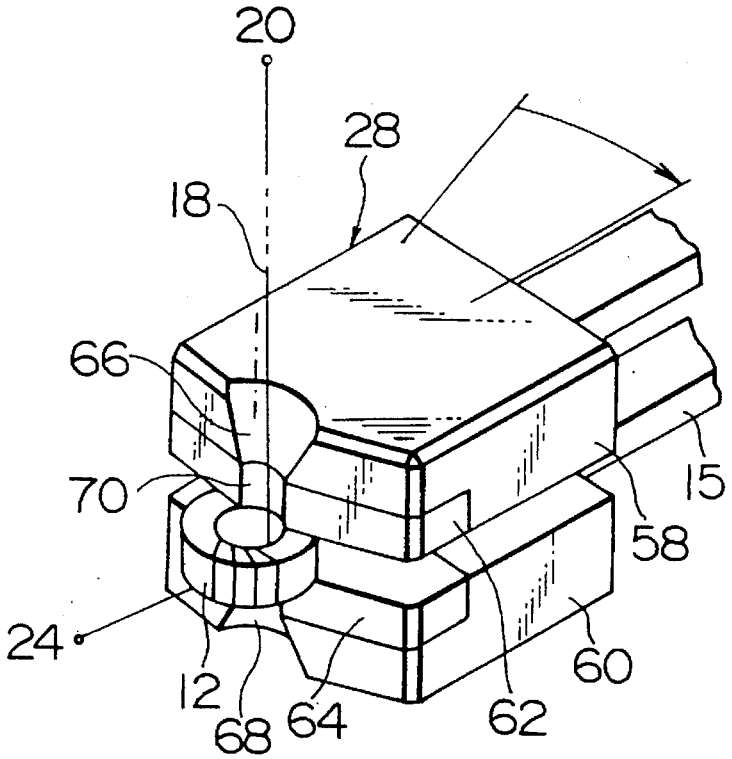
FIG. 4 is a perspective view showing the structure of a tip claw portion of a core rotating clamp illustrated in FIG. 2.

The tip claw portion of the core rotating clamp 28 comprises, as shown in FIG. 4, grasp claws 58 and 60 and urethane rubbers 62 and 64 as in the core turning clamp 26 shown in FIG. 3. The tip claw portion of the core rotating 28 holds a part of the core 12 upon traveling from right to left in FIG. 2. The grasp claws 58 and 60 are separated from each other and opened to release core 12 when the core rotating clamp 28 is withdrawn to the right. Longitudinal slots 66 and 68 are formed in the center of the grasp claw 58 and 60, respectively. Each of the longitudinal slots 66 and 68 is formed into a half-conical shape similar to the slots 50 and 52. The urethane rubbers 62 and 64 are provided with semi-circular notches 70 and 72 (concealed by the core 12), respectively. The notch 70 communicates with the slot 66 while notch 72 communicates with the slot 68. The tip surfaces of the grasp claws 58 and 60 are cutoff obliquely at both sides of the respective slots 66 and 68. The tip surfaces may be cutoff obliquely at either one side of the respective slots 66 and 68. In addition, the urethane rubber 62 of the grasp claw 58 of the core rotating clamp 28 has no concave portion and thus the core 12 is held between the flat surfaces of the urethane rubbers 62 and 64.

Figure 5:
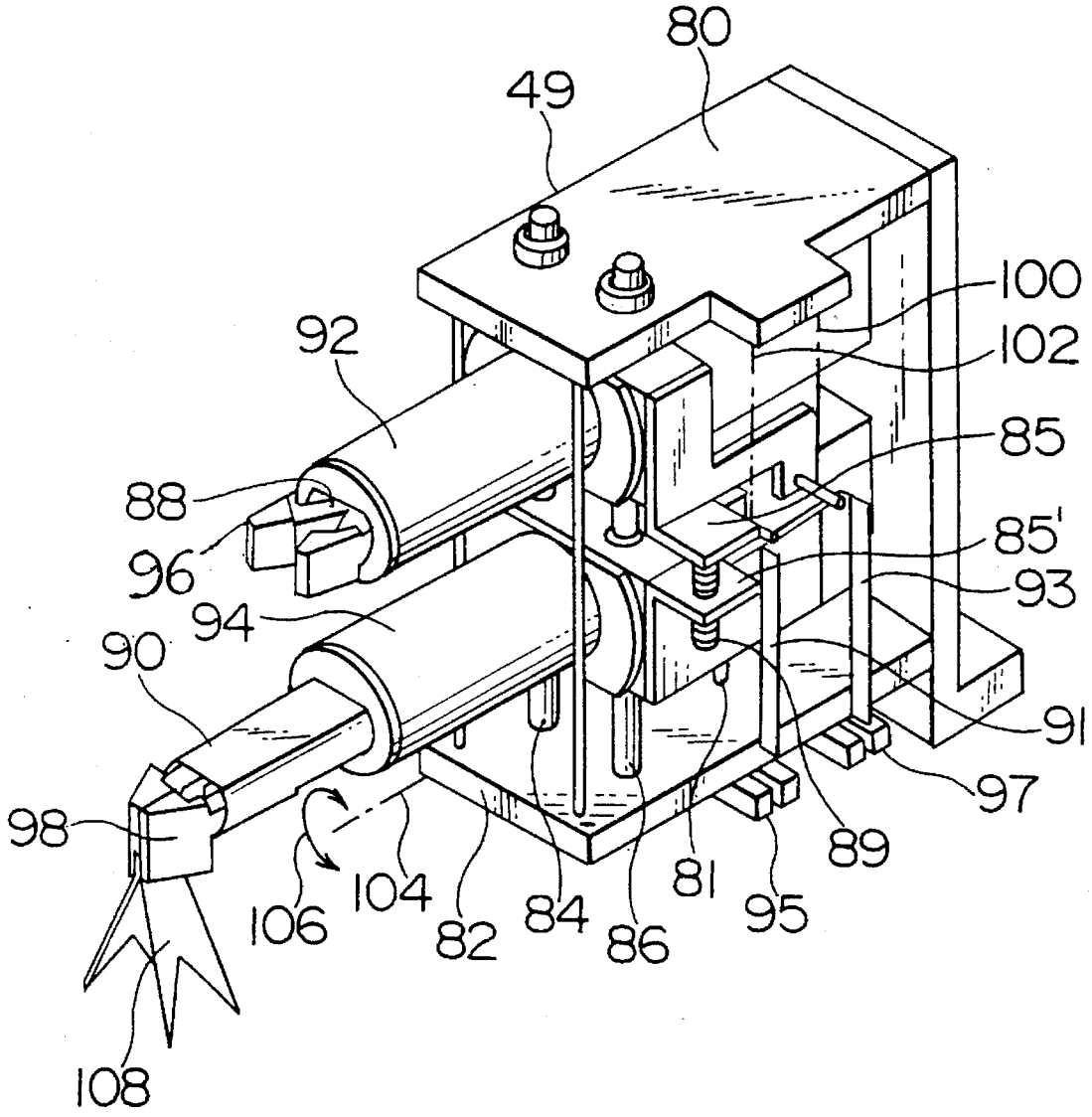
FIG. 5 is a perspective view showing the structure of an essential part of a wire chuck assembly illustrated in FIG. 2.

FIG. 5 is a perspective view showing the structure of a wire chuck holder 49 of the wire chuck assembly 30. The wire chuck holder 49 is composed of a pull chuck 88 and an insertion chuck 90. The pull chuck 88 is so provided as to be movable upward and downward along two slide shafts 84 and 86 arranged between upper and lower base plates 80 and 82. The slide shafts 84 and 86 are parallel to each other and perpendicular to the base plates 80 and 82. The pull chuck 88 is fixedly secured to the slide shaft 86 and engages the slide shaft 84 with a play. Likewise, the insertion chuck 90 is fixedly secured to the slide shaft 84 and engages the slide shaft 86 with a play. A grasp claw 96 of the pull chuck 88 is driven by an air cylinder 92 while a grasp claw 98 of the insertion chuck 90 is driven by an air cylinder 94. The wire is held by the grasp claws 96 and 98 upon being advanced and is separated therefrom when the grasp claws 96 and 98 are retracted. In this event, operation of the grasp claw 96 can be made independent of that of the grasp claw 98. A screw rod 81 is integrally projected from the insertion chuck 90 at the side of the lower base plate 82 to engage the chuck 90 with the base plate 82 with a play. A nut 83 is threaded outside the lower base plate 82 (see FIG. 13(A)) to keep the insertion chuck 90 away from the pull chuck 88 at a predetermined position closer to the upper base plate 80 through the force of an extension spring 102.

The pull chuck 88 is connected to the upper base plate 80 through an extension spring 100. L-shaped metal fittings 85 (only one is shown in FIG. 5) are secured to both ends of the pull chuck 88. Each of the L-shaped metal fittings 85 is so arranged that one end thereof is projected outward at the side of the insertion chuck 90. An L-shaped plate 85' is secured to one side (closer side to the slide shaft 86 in the figure) of the insertion chuck 90 in an opposed relation with the L-shaped metal fitting 85. An adjusting screw rod 89 is threadedly mounted to the L-shaped plate 85', allowing adjustment of the distance between the L-shaped metal fittings 85 and the end of the screw rod 89. The insertion chuck 90 is connected to the upper base plate 80 through the extension spring 102 and is forced to the pull chuck 88. The chucks 88 and 90 are normally arranged, as will be described later, at a predetermined narrow space. The reciprocating core reverse mechanism 47 in FIG. 2 allows the wire chuck assembly 30 to be reciprocated over 180° in the direction depicted by an arrow 106 (FIG. 5) on an axis 104 represented by a dot-dash line in FIG. 5. A tip grasp claw 98 of the insertion chuck 90 is provided with a guide 108 for the wire 18.

A short shutter member 91, a long shutter member 93, a first detector 95 and a second detector 97 are for applying a predetermined tension to the wire 18. This will later be described more in detail.

Figure 6:
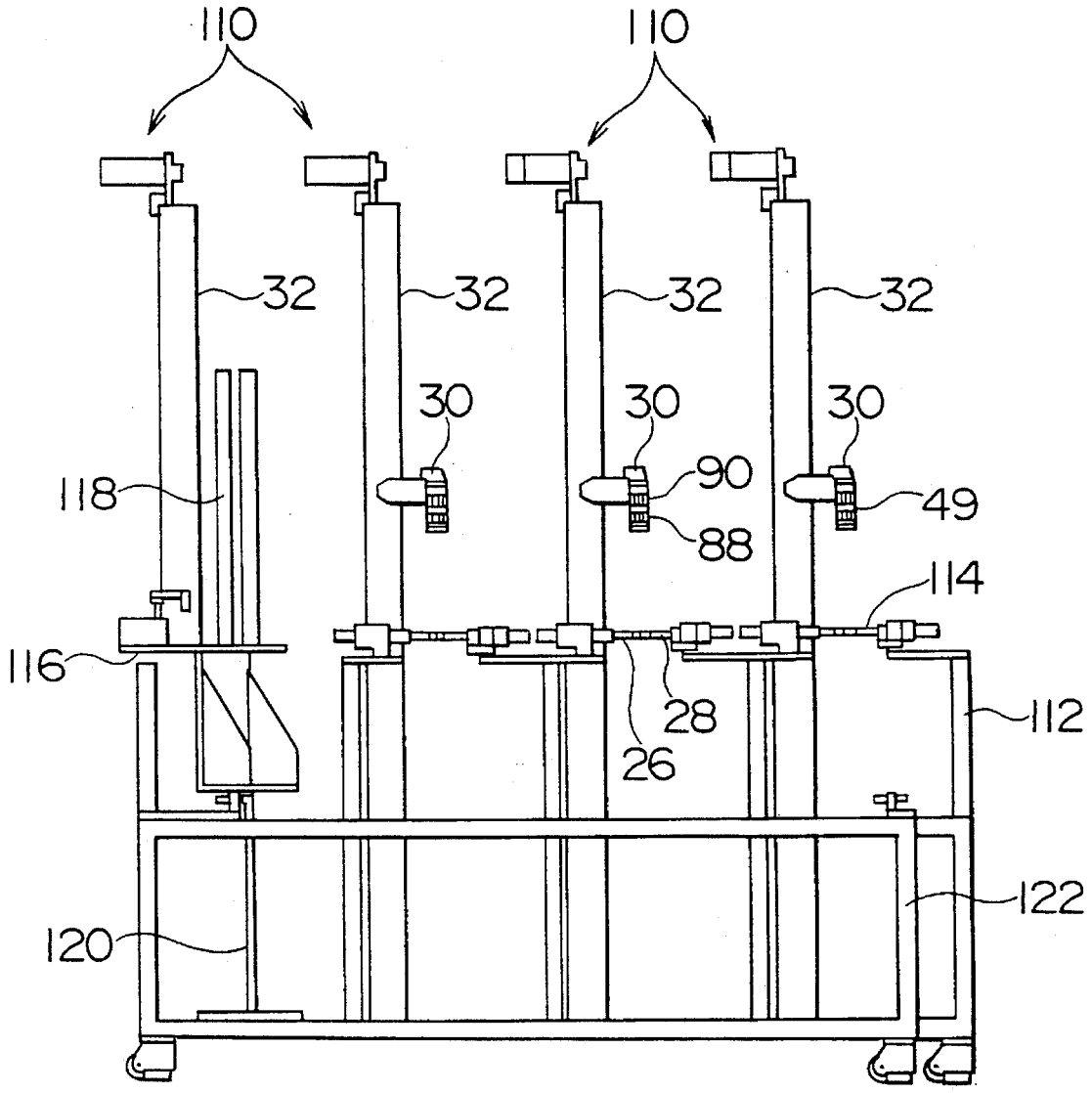
FIG. 6 is a front view of an automatic four-linkage toroidal coil winding machine in which four automatic winding machine shown in FIG. 2 are aligned.
Figure 7:
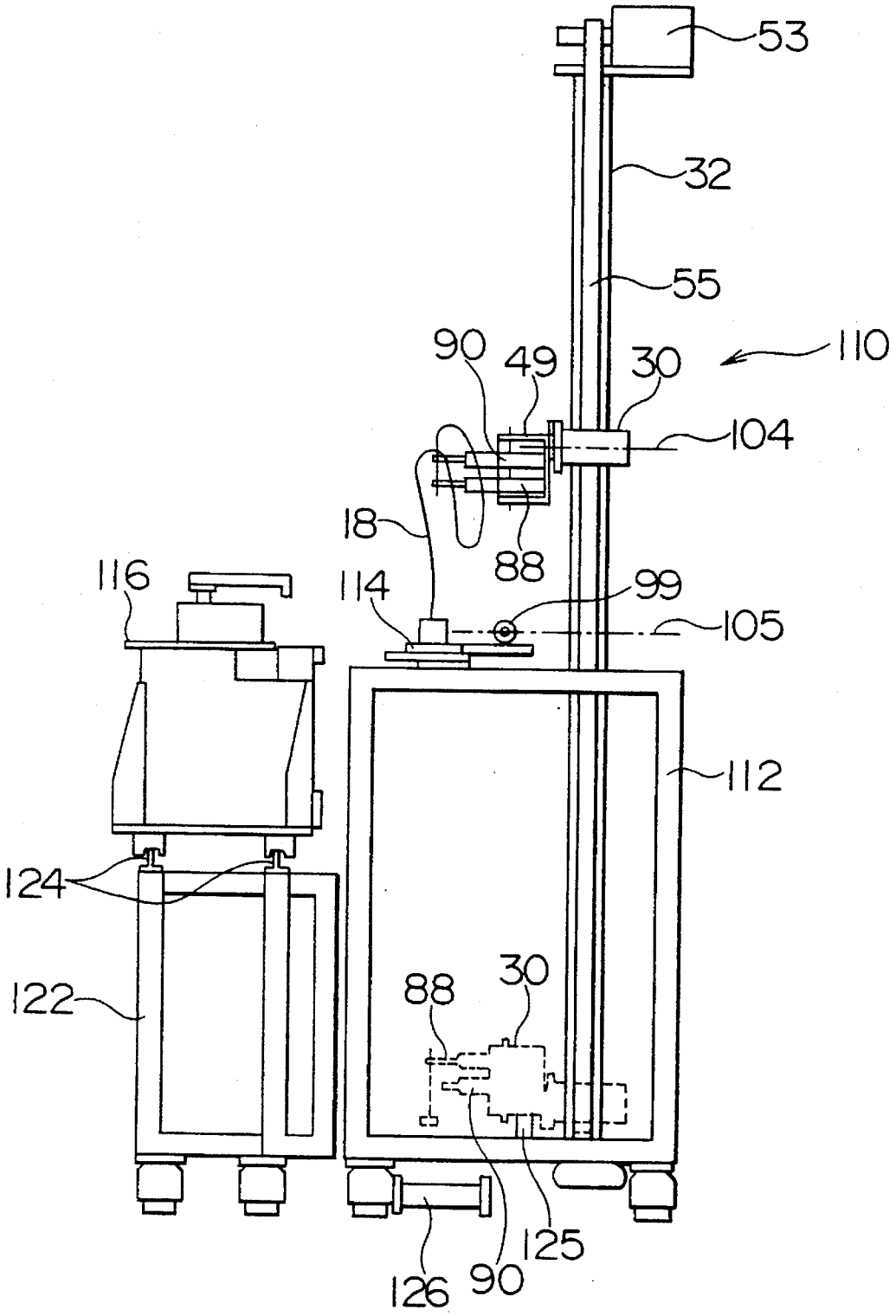
FIG. 7 is a right-hand side view of the automatic four-linkage toroidal coil winding machine shown in FIG. 6.

FIG. 6 is a front view of an automatic four-linkage toroidal coil winding machine in which four automatic winding machine shown in FIG. 2 are aligned and FIG. 7 is a right-hand side view thereof.

In these figures, each of four automatic winding machines 110 comprises a core clamp assembly 114 disposed on a rack 112 and the wire chuck assembly 30 capable of sliding along the longitudinal guide rail 32. The wire chuck assembly 30 is integrally connected to a synchronous belt 55 which in turn is connected to a servo-motor 53. The servo-motor 53 is disposed at the top of the guide rail 32. The servo-motor 53 is controlled by voltage and the number of pulses to be supplied thereto a pulse motor 53, thereby the wire chuck assembly 30 rises or is lowered along the guide rail 32.

The core clamp assembly 114 consists of the core turning clamp 26 and the core rotating clamp 28 shown in FIG. 2. In FIG. 6, the core clamp assembly 114 and the wire chuck assembly 30 are omitted in the left-side automatic winding machine 110 to avoid obfuscation. A core/wire feeding machine 116 is arranged at the front side of each automatic winding machine 110 aligned. The core/wire feeding machine 116 comprises a core container 118 and a wire container 120 at the upper and lower positions, respectively, thereof which are not shown in FIG. 7. The core/wire feeding machine 116 travels along a rail 124 (see FIG. 7) mounted on a rack 122 to feed a core and the wire upon being stopped at a predetermined position corresponding to each automatic winding machine 110. A belt conveyer 126 is provided inside the rack 112 at the lower portion of the alignment of the winding machines 110 in parallel with the latter. The belt conveyer 126 is for use in recovering wound products when each of four winding machines 110 carries out the same winding operation. When these winding machines are applied to wind the wire at different turns, the belt conveyer 126 may be used for container boxes which are for containing the wound products.

Figure 8:
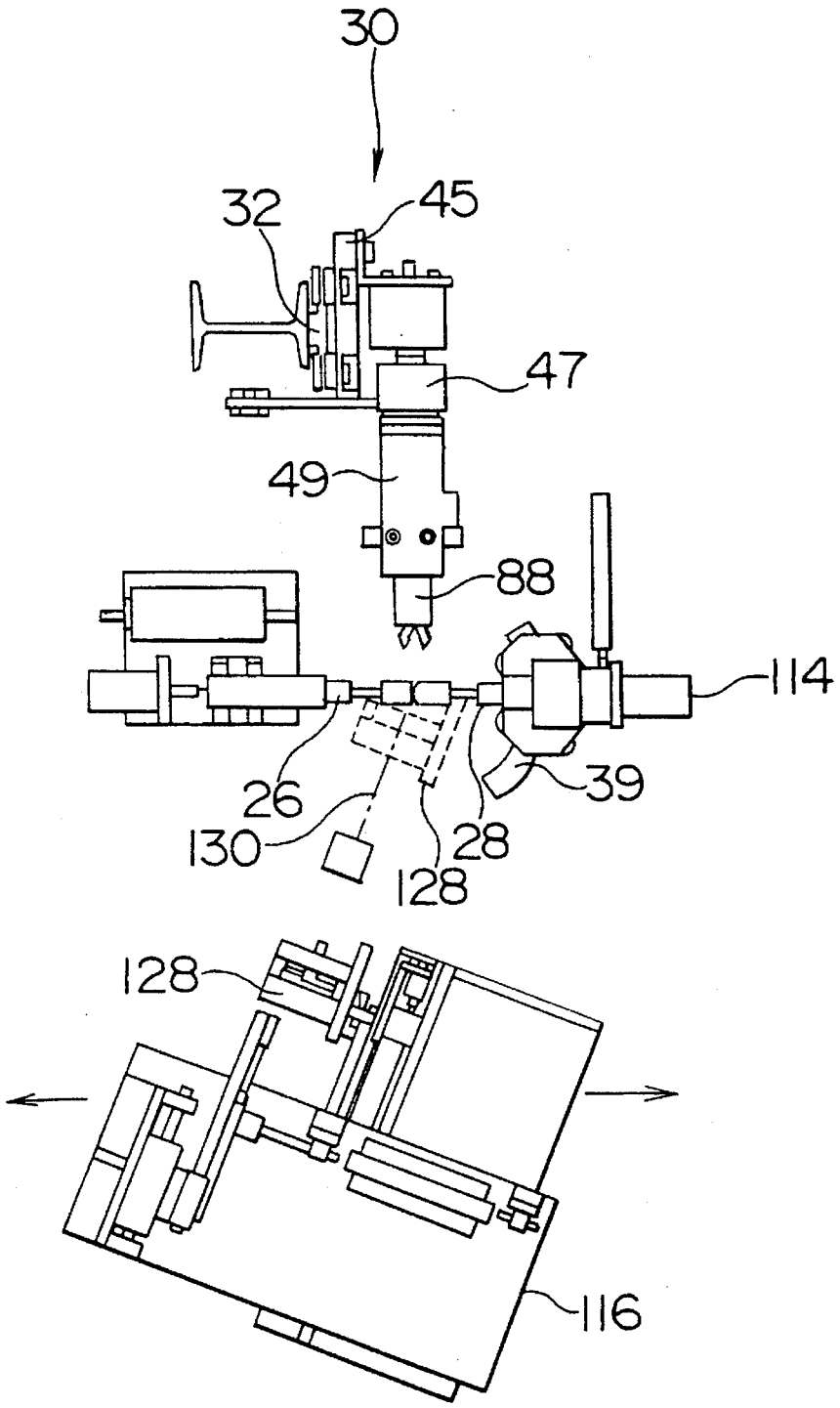
FIG. 8 is a plan view of an essential part showing position relationship between one of four automatic winding machine 110 and a core/wire feeding machine 116 stopped at a predetermined position in the automatic winding machine 110.

FIG. 8 is a plan view of an essential part showing position relationship between one of four automatic winding machines 110 and a core/wire feeding machine 116 stopped at a predetermined position in the automatic winding machine 110. In these figures, the core clamp assembly 114 and the wire chuck assembly 30 are similar to those shown in FIG. 2 and thus a detailed description thereof is omitted here.

The core/wire feeding machine 116 comprises a wire nozzle/cutter member 128. The wire nozzle/cutter member 128 moves with an arm (not shown) holding one of the cores in the oblique direction depicted by a dot-dash line 130 in FIG. 8. The wire nozzle/cutter member 128 is stopped at the position indicated by a broken line where it crosses with the core turning clamp 26 at an acute angle. The wire nozzle/cutter member 128 first feeds a core to the core turning clamp 26 in the stand-by condition. The core turning clamp 26 holds the core being fed thereto. Next, only a wire nozzle (not shown) provided in the wire nozzle/cutter member 128 rises and passes through a cutter portion (not shown). The wire nozzle is inserted into the central aperture 22 of the core to eject upward the leading end 20 of the wire beyond the core. At that moment, the pull chuck 88 of the wire chuck assembly 30 grasps the leading end 20 of the wire and travels upward along the longitudinal guide rail 32 while pulling the wire out of the wire nozzle. The pull chuck rises to a predetermined position and is stopped there. Subsequently, the wire nozzle is lowered and returned downward of the cutter portion. The wire nozzle/cutter member 128 revolves upward or corkscrews up until it reaches the position horizontal to the radial direction of the core depicted by the dot-dash line 130. When the wire nozzle/cutter member 128 comes to this orientation, the wire contacts the bottom surface of the core. The pull chuck 88 of the wire chuck assembly 30 pulls the leading end 20 of the wire being contact with the core. A predetermined tension is applied to the wire and, following which the core turning clamp 26 clamps the core together with the tailing end 24 (FIG. 1) of the wire. A cutter (not shown) cuts the wire out of the wire nozzle and then the wire nozzle/cutter member 128 revolves downward or corkscrews down under the core to the original position in the core/wire feeding machine 116. This completes feeding of the core and the wire.

The above mentioned four-linkage automatic toroidal coil winding machine according to the present invention is a longitudinal and upright core reversing type. Such winding machine occupies less space for equipment and can be combined into multiple linkage with only one core/wire feeding machine. This means that a limited space can be effectively used for this cost-saving equipment of high performance. In addition, maintenance and operational management can be made easily.

Figure 9A:
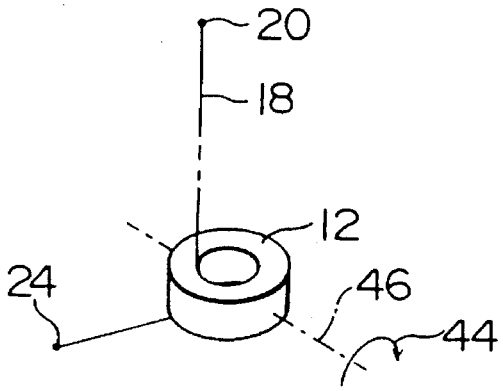
FIGS. 9A to 9F depict steps for describing the winding process performed by the automatic toroidal coil winding machine according to an embodiment of the present invention.

Next, a process for manufacturing the toroidal coil illustrated in FIG. 1 is described with reference to FIGS. 9 through 11. FIG. 9A shows the core 12 not being grasped and turned by the core turning clamp 26 with the tailing end 24 of the wire 18. The core rotating clamp 28 located at its original position shown in FIG. 2 grasps the core 12 fed from the core/wire feeding machine 116 shown in FIG. 8. As mentioned above, the core/wire feeding machine 116 inserts the leading end 20 of the wire 18 into the central aperture 22 of the core 12 downward thereof held by the core rotating clamp 28. At that time, the pull chuck 88 is located upward from the insertion chuck 90 as shown in FIG. 5. The leading end 20 of the wire 18 extending upward from the central aperture 22 of the core 12 is grasped and raised upward to a predetermined distance by the pull chuck 88 of the wire chuck assembly 30 retracted to the right side of the figure. The core/wire feeding machine 116 pulls up the end of the wire closer to the tailing end 24 in the direction depicted by the arrow 48 in FIG. 2. The core/wire feeding machine 116 then cuts the wire 18 at a predetermined position to provide the tailing end 24. Subsequently, the core 12 and the tailing end 24 of the wire 18 are grasped by the core turning clamp 26 with its concave portion 40 formed in the urethane rubber 38 faced upward as shown in FIG. 3. The wire chuck assembly 30 is then moved upward to apply a predetermined tension to the wire 18. With the tension applied to the wire, the wire chuck assembly 30 is slightly lowered to loose the wire 18 and the core 12 is away from the core rotating clamp 28. This corresponds to the condition shown in FIG. 9A. At that time, the insertion chuck 90 advances to the same position as the pull chuck 88 to hold the leading end 20 of the wire 18.

Figure 9D:
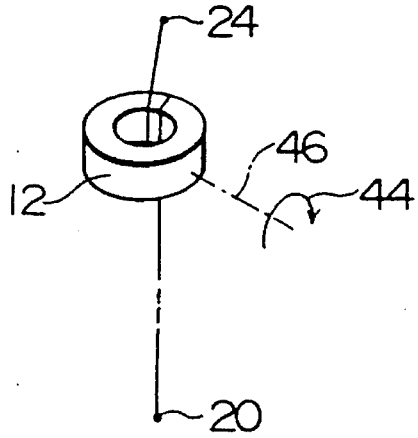
Figure 9B:
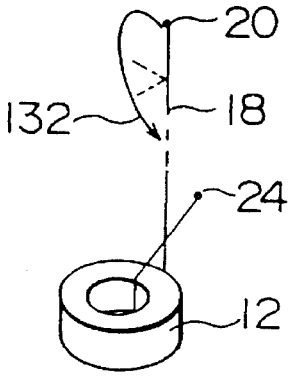

The core turning clamp 26 turns the core 12 on the rotation axis 46 shown in FIG. 9A in the direction depicted by the arrow 44 into the condition illustrated in FIG. 9B. The core 12 turns in such a direction that the wire 18 is wound therearound, so that it is possible to loosely lay the wire 18 on the radially external periphery of the core 12 generally orthogonal to the rotation axis 46. Under such a circumstance, the concave portion 40 formed in the urethane rubber 38 of the core turning clamp 26 is faced downward.

Next, the leading end 20 of the wire 18 is turned counter-clockwise relative to the front of the machine as depicted by an arrow 132 in FIG. 9B. This is achieved by means of half-rotating the wire chuck assembly 30 counter-clockwise from the position shown in FIG. 5 on the axis 104 with the leading end 20 being held by the pull chuck 88 and the insertion chuck 90. In addition, when the wire chuck assembly 30 reversed upside-down from the position shown in FIG. 5 moves downward and is stopped just above the core 12, the pull chuck 88 releases the wire 18 and is retracted. The entire structure of the wire chuck assembly 30 is moved slightly downward with the wire 18 being held only by the insertion chuck 90. Thus, the insertion chuck 90 enables the insertion of leading end 20 of the wire into the central aperture 22 of the core 12.

Before completion of insertion, the pull chuck 88 is moved downward beyond the core 12. The pull chuck 88 is moved ahead to the same position as the insertion chuck 90 to hold the leading end 20 passing through and extending downward from the central aperture 22. The insertion chuck 90 releases the wire 18 and is retracted, following which the wire chuck portion 30 moves down to apply the tension to the wire with the pull chuck 88. This condition is shown in FIG. 9C. The insertion chuck 90 at this moment is located beneath the core 12 while holding the wire 18 at the advanced position as same as the pull chuck 88. The wire 18 is thus tightly laid on the internal periphery of the core 12.

Next, the core 12 is held by the core rotating clamp 28 and then separated from the core turning clamp 26. The core rotating clamp 28 slides on the circular rail 39 (see FIG. 2) by an angle equal to one pitch of winding in the direction (counter-clockwise as seen from the above) depicted by an arrow 134 in FIG. 9C. In this event, the core rotating clamp 28 rotates the core 12 without changing the center thereof. The core 12 after completion of this one-pitch rotation is shown in FIG. 9D.

When the core turning clamp 26 holds the core 12 in the condition shown in FIG. 9D, the core rotating clamp 28 releases the core 12 and is retracted. The core turning clamp 26 then turns in the same direction as shown in FIG. 9A. This results in the core 12 being positioned as shown in FIG. 9E.

Next, the pull chuck 88 of the wire chuck assembly 30 releases the wire 18 and is retracted. The entire structure of the wire chuck assembly 30 is turned over 180° to rotate the leading end 20 of the wire 18 over 180° in the clockwise (as seen from the front view) direction as depicted by an arrow 136. The leading end 20 then faces upward. Subsequently, the insertion chuck 90 moves upward to insert the leading end 20 of the wire into the central aperture 22 downwardly therefrom. The pull chuck 88 located above the core 12 is advanced to hold the leading end 20 extending upward from the core 12. Upon grasping the leading end 20, the pull chuck 88 further travels upward to apply tension to the wire 18 as shown in FIG. 9F. The core rotating clamp 28 holds the core 12 at the condition shown in FIG. 9F. When the core turning clamp 26 is separated from the core 12, the core rotating clamp 28 slides on the circular rail 39 by an angle equal to one pitch of winding in the direction (clockwise) depicted by an arrow 138 in FIG. 9F. As a result, the core 12 is rotated and the core rotating clamp 28 returns to its original position shown in FIG. 2.

Figure 9E:
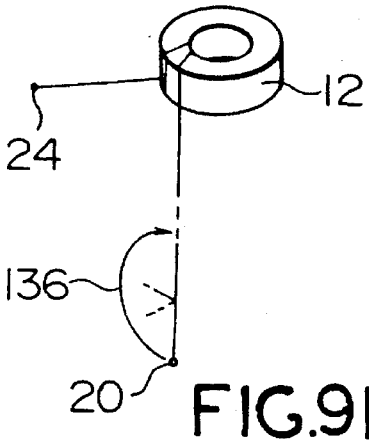
Figure 9C:
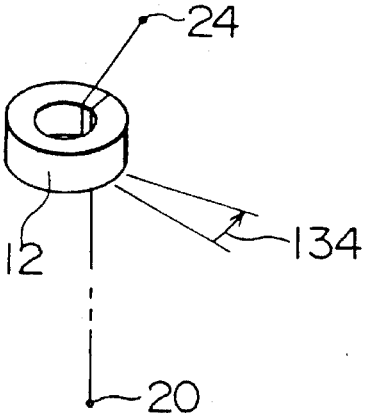
Figure 9F:
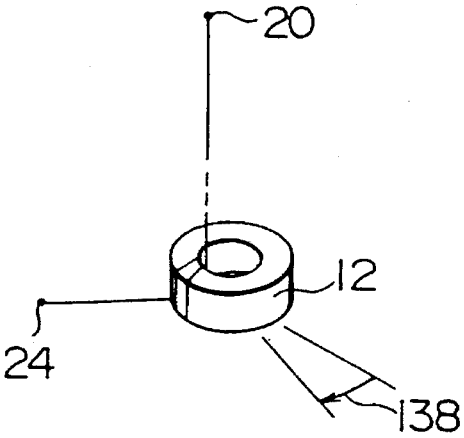
Figure 10A:
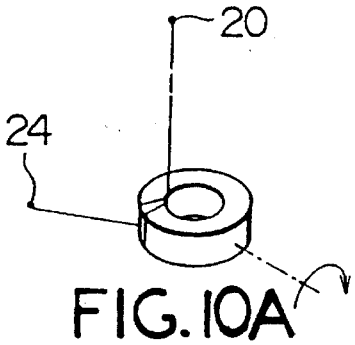
FIGS. 10A to 10J disclose a series of steps for describing the winding process performed by the automatic toroidal coil winding machine according to another embodiment of the present invention.
Figure 10E:
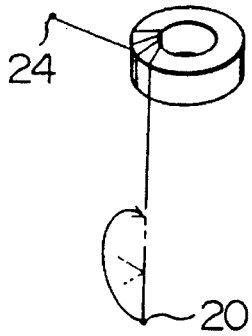
Figure 10I:
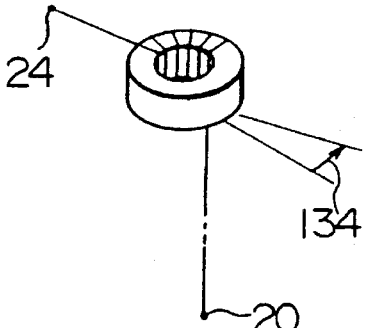
Figure 10B:
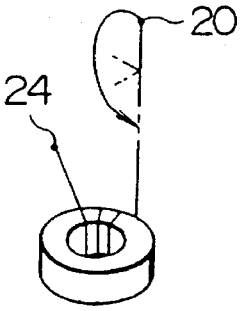
Figure 10F:
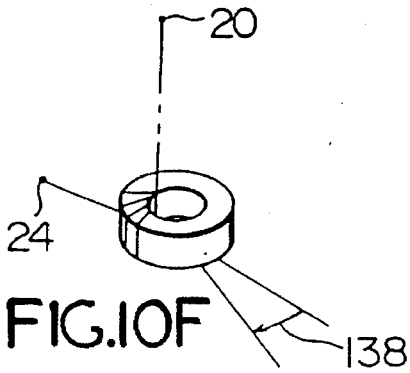
Figure 10C:
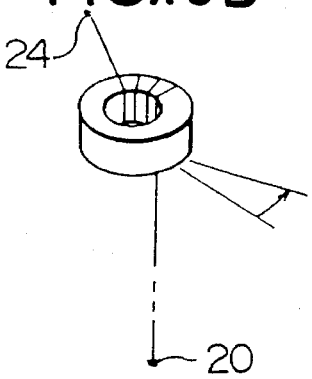
Figure 10G:
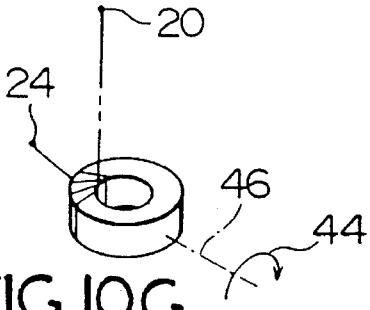
Figure 10D:
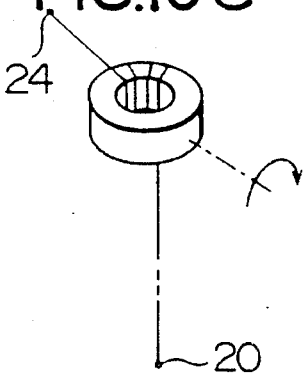
Figure 10H:
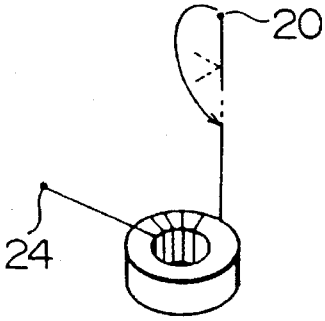
Figure 11A:
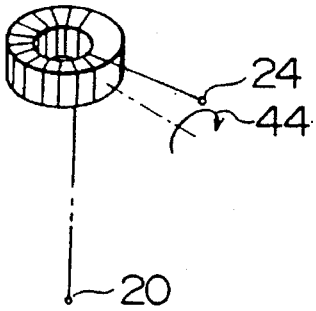
FIGS. 11A to 11L depict a series of steps for describing the winding process performed by the automatic toroidal coil winding machine according to a further embodiment of the present invention.
Figure 11E:
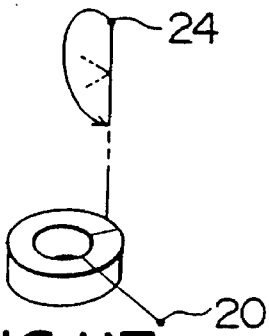
Figure 11I:
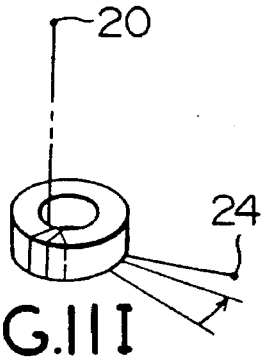
Figure 11B:
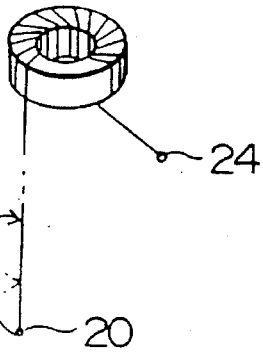

The steps shown in FIGS. 10A, 10B and 10C and in FIGS. 10G, 10H and 10I are repetitions of steps 9A, 9B and 9C while the steps shown in FIGS. 10D, 10E and 10F and in the steps shown in FIGS. 11A and 11B are repetitions of steps shown in FIGS. 9E and 9F. While the earlier steps are not shown in the drawing for FIGS. 11A to 11L, the number of winding turns at the step before FIG. 11A is equal to thirteen (accurately, 13.5 turns). This corresponds to the completion of the winding of the first layer.

Figure 10J:
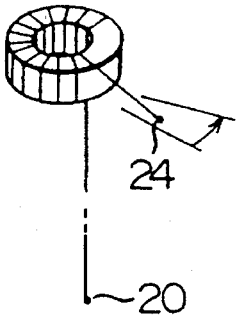
Figure 11F:
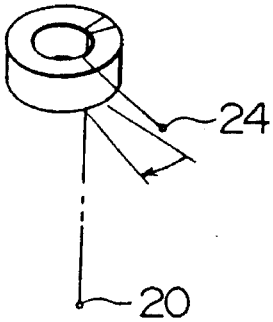
Figure 11J:
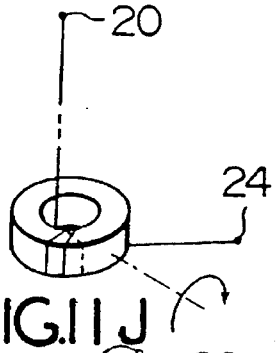
Figure 11C:
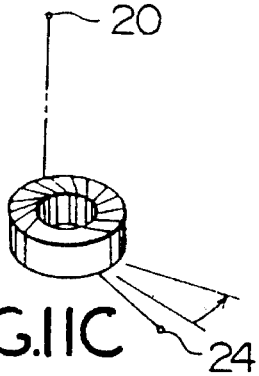
Figure 11G:
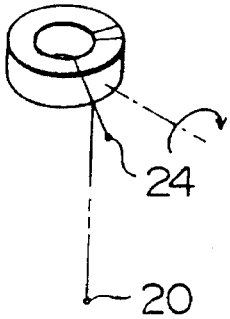
Figure 11K:
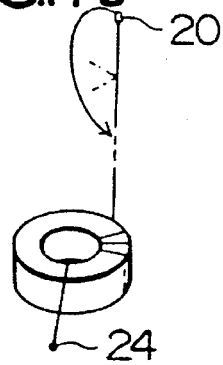
Figure 11D:
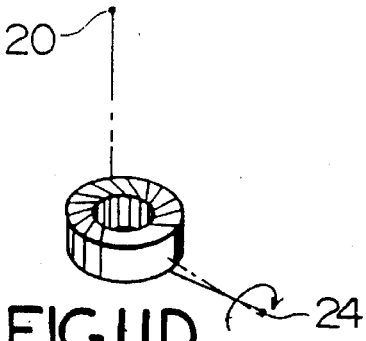
Figure 11H:
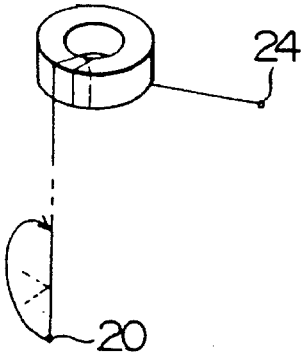

In the step of FIG. 11C, an additional loop is formed as compared with the step of FIG. 10J. The number of winding turns is thus equal to fourteen (accurately, 14.5 turns). At the step of FIG. 11C, core rotating clamp 28 rotates the core 12 in the same direction (counter-clockwise) as in FIG. 10J in FIG. 1. Accordingly, the wire overlaps the first layer as shown in FIG. 11D.

Figure 11L:
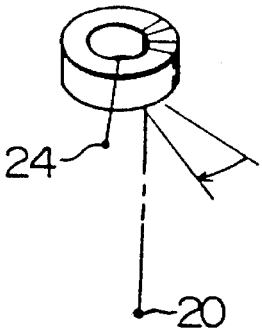

The second layer is formed by means of repeating the above mentioned steps, i.e., turning the core, inserting the leading end of the wire into the central aperture, applying the tension to the wire and rotating the core. The process for winding the second layer differs from that for the first layer. More particularly, as shown in FIGS. 11F and 11L, the core is rotated clockwise after being subjected to the tension downward and is rotated counter-clockwise after being subjected to the tension upward. In figures representing steps after FIG. 11H, the tailing end 24 of the wire is depicted by the solid line and the last winding of the first layer is depicted by the broken line. Other turns are all omitted from these figures to avoid obfuscation.

While the coil shown in FIG. 1 is double-layered with 26 winding turns (26.5 turns), the present invention is applicable to a coil of three or more layers by means of repeating the steps for preparing the first and the second layers.

According to the above mentioned embodiment of the present invention, rotation of the core on the central axis thereof is performed by the rotating arrangement separate from the arrangement for reversing the core on the diametrical axis thereof. The winding can thus be made with high accuracy at a predetermined pitch even for the lap winding. In addition, all steps can be made automatically only with a simple automatic machine. Another advantage of the present invention is that it is possible to wind the wire on a small core without adversely affecting the insulating layer. Further, the increased number of turns will cause no serious problem by the operational considerations.

According to the above mentioned embodiment, the core clamp assembly consists of separate members, i.e., the core turning clamp and the core rotating clamp for feeding. The grasp claw of the core turning clamp is provided with a concave portion, allowing the tailing end 24 radially outwardly extending from the core to be held without being deformed or curved by the core turning clamp not being inclined. Further, it is possible to shift positively the position where the wire is to be wound by means of rotating the core because the core rotating clamp slides on the circular rail after re-holding the core. This results in increased yields while minimizing the problem of irregular winding. In addition, the winding pitch can readily be varied even for the lap winding.

The above mentioned four-linkage automatic toroidal coil winding machine according to the present invention is a longitudinal and upright core reversing type. Such winding machine occupies less space for equipment and can be combined into multiple linkage with only one core/wire feeding machine. This means that a limited space can be effectively used for this cost-saving equipment of high performance. In addition, maintenance and operational management can be made easily.

The above mentioned method for winding the wire relies on rotation and turns of the core as well as on turn, insertion and pull of the wire. The same position of the leading end of the wire is repeatedly held and pulled before reversing the orientation. Consequently, the wire is curved at the same position upon being reversed and is deformed due to the work hardening. Such work hardening may be a cause of wire breakage or non-uniform formation of the loop. If the loop is reduced roughly, the wire may further be wriggled to form 8-shaped loops or even a kink may be caused to prevent uniform winding of the wire.

With this respect, to prevent the wire from being wriggled or twisted is the major challenge in manufacturing a toroidal coil. A solution of the problem of wriggle is, as described in the following embodiments, to provide a wire loop supporting member at the opposite side to where the leading end of the wire is turned and to shift the position to be held closer to the tailing end.

Figure 12A:
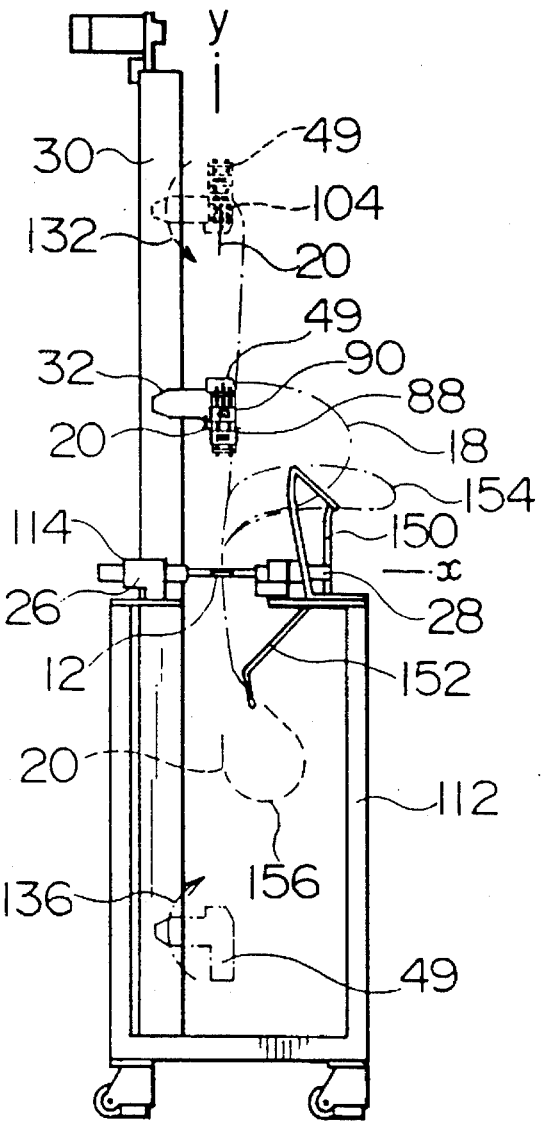
Figure 12B:
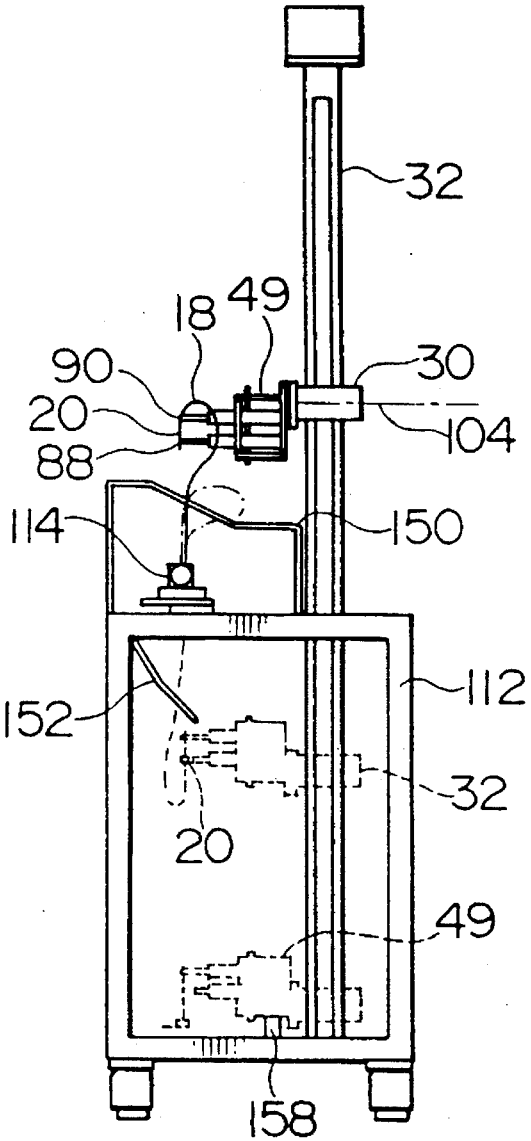

FIGS. 12A and 12B show another embodiment of the automatic toroidal core winding machine with a wire loop supporting members provided, in which FIGS. 12A and 12B show the front and right-hand side view, respectively, of the winding machine. The winding machine illustrated in FIGS. 12A and 12B corresponds either one of the four winding machines 110 arranged into the four-linkage automatic winding machine shown in FIG. 6. Detailed description of the similar parts will be omitted to avoid redundancy.

As shown in FIGS. 12A and 12B upper loop supporting member 150 and a lower loop supporting member 152 are attached to the rack 112 at the closer side to the core rotating clamp 28. The upper loop supporting member 150 is formed by means of bending a bar (e.g., 5–6 mm in diameter) of metal or resin having a smooth surface at nine or ten points into a desired shape of three-dimension. The lower loop supporting member 152 is formed by means of bending a short bar of metal or resin at two points at obtuse angles.

Movement of the wire 18 and the leading end 20 thereof caused by the wire chuck holder 49 is described with reference to FIG. 12A. When the wire is located above an x axis, the wire chuck holder 49 is turned in the direction depicted by the arrow 132 (counter-clockwise) at the left side of a y axis. Consequently, the leading end 20 of the wire faces downward as depicted by the broken dot-dash line and formation of the wire loop is started at the right side of the y axis. When the wire chuck holder 49 is lowered to the position depicted by the solid line, the wire 18 is formed into a large open-loop extending towards the x axis. The portion of the wire 18 extending from the core is abutted to the upper loop supporting member 150 as shown in FIG. 12A. When the wire chuck holder 49 is lowered further, the loop of the wire 18 moves along the slope of the upper loop supporting member 150. The loop supporting member 150 thus contributes to provide uniform shape and orientation of the loops.

When the wire chuck holder 49 is lowered to insert the leading end 20 of the wire into the central aperture of the core 12, the closed loop of the wire 18 becomes more flat extending along the x axis as depicted by a dot-dash line 154. Without the upper loop supporting member 150, the wire is substantially twisted wherein the closed large loop may be formed into an 8-shape. The loop supporting member 150 abuts the loop of the wire 18 to avoid the loop head to be wriggled. This means that the loop will never be formed into an 8-shape.

The wire chuck holder again grasps the leading end 20 of the wire beneath the x axis. The closed loop is gradually reduced and disposed away from the loop supporting member 150 to be wound on the core. As mentioned above, the loop supporting member 150 allows the loop to be formed in the uniform formation and orientation. Accordingly, it becomes possible to wind the wire on the core at a desired pitch.

Beneath the x axis, the wire chuck holder 49 is turned in the direction (clockwise) towards the left side of the y axis as depicted by the dot-dash line 136. The loop of the wire 18 is thus formed at the right side of the y axis. The broken line 156 represents the loop of the wire when the wire chuck holder 49 rises to half the height of the rack 112. The loop represented by the broken line is shown in FIG. 12A and the loop of the wire together with the wire chuck holder 49 is shown in FIG. 12B. In such a case, the open-loop of the wire is abutted to the lower loop supporting member 152 at or near the free end thereof. The shape and orientation of the loop are also stabilized. The closed loop can thus be reduced in size more smoothly with the lower loop supporting member 152 and it is possible to wind the wire on the core at a desired pitch during rising of wire chuck holder 49.

The wire chuck holder 49 after completion of roundturn is lowered without changing its orientation with the pull chuck 88 facing ahead. The wire chuck holder 49 is then abutted to an original position detector 158 and the coil then released.

FIGS. 13 through 16 are views for use in describing a mechanism and operation of the wire chuck assembly 30 to avoid the wire breakage by means of shifting a position of the leading end 20 of the wire 18 to be held.

FIGS. 13A through G are views for use in describing operation of the wire chuck holder 49 of the wire chuck assembly 30 shown in FIG. 5.

Figure 13A:
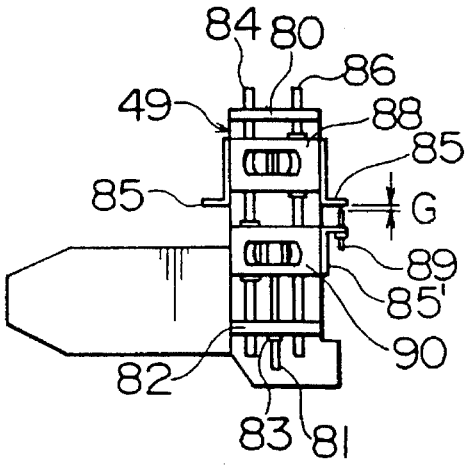
FIGS. 13A to 13G are views for use in describing the winding process performed by the automatic toroidal coil winding machine according to an embodiment of the present invention.
Figure 13B:
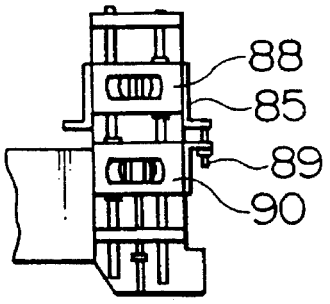

FIG. 13A shows a condition where the leading end 20 (not shown) of the wire 18 is held only by the pull chuck 88 and the wire chuck holder 49 moves upward. In this state, the L-shaped metal fitting 85 and the screw rod 89 are spaced from each other at a gap G. FIG. 13B shows a condition where a predetermined tension is applied upwardly to the wire 18 (not shown) to lay the wire on the interior periphery of the core. In this state, the L-shaped metal fitting 85 is abutted to the screw rod 89. Both of the pull chuck 88 and the insertion chuck 90 slide downward until the short shutter member 91 reaches a first detector 95 (FIG. 5).

Figure 13C:
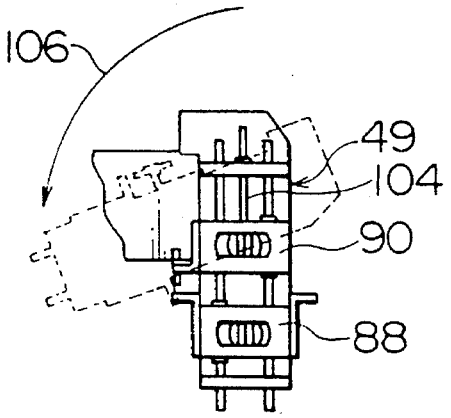

After the wire chuck holder 49 in the position shown in FIG. 13B is slightly lowered to return to the condition shown in FIG. 13A with a gap G, the insertion chuck 90 grasps the wire 18 as well and rotates the wire chuck holder 49 downward over 180° on the rotation axis 104 in the direction depicted by the arrow 106 into the orientation represented by the solid line as shown in FIG. 13C. The insertion chuck 90 and the pull chuck 88 hold the leading end 20 of the wire 18 apart from each other at the gap G. The wire 18 is curved near the rotation axis 104 and formed into a loop, as described above.

Figure 13D:
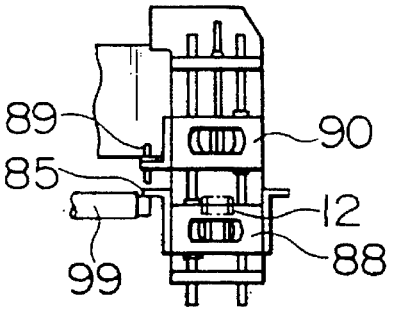
Figure 13E:
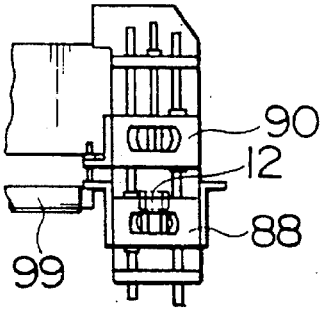

The wire chuck holder 49 which is downwardly oriented as shown in FIG. 13C is lowered to just above the toroidal core and stopped there temporary. At the same time, the pull chuck 88 releases the leading end 20 of the wire and then the wire chuck holder 49 is slightly lowered. In this event, as shown in FIG. 13D, the leading end 20 (not shown) of the wire is inserted into the central aperture of the core 12 indicated by the dot line. At the same time, the L-shaped metal fitting 85 of the wire chuck holder 49 abuts a stopper 99 to stop the pull chuck 88. As shown in FIG. 2, the stopper 99 is so provided as to move forward and backward in parallel to the core turning clamp 26. At the advanced position, the tip of the stopper 99 is projected into the longitudinal passage of the wire chuck holder 49. With the L-shaped metal fittings 85 abutted to the stopper 99, the insertion chuck 90 holding the leading end 20 of the wire slightly is lowered and stopped when the tip of the screw rod 89 abuts the L-shaped metal fittings 85. In other words, the gap G between the insertion chuck 90 and the pull chuck 88 is equal to zero as shown in FIG. 13E.

Figure 13F:
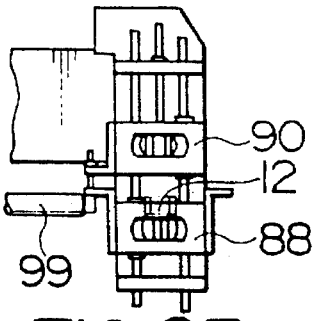
Figure 13G:
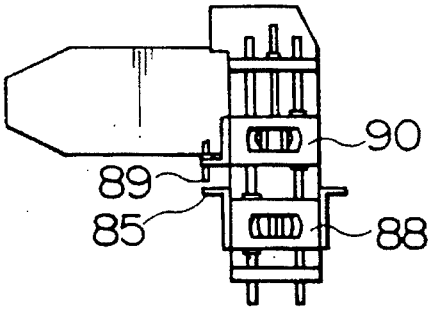

The pull chuck 88 again grasps the leading end 20 (not shown) of the wire with no gap G formed and the insertion chuck 90 releases the wire 18 (see FIG. 13F to retract the stopper 99 from the passage of the wire chuck holder 49. As shown in FIG. 13G, the L-shaped metal fittings 85 are separated from the screw rod 89 and the pull chuck 88 returns to a free state with the gap G. The pull chuck 88 is lowered while remaining this condition to reduce the loop of the wire.

Figure 14:
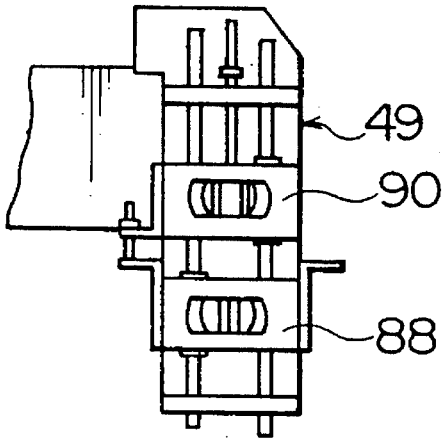
FIG. 14 is a view for use in describing the winding process performed by the automatic toroidal coil winding machine according to an embodiment of the present invention.
Figure 15:
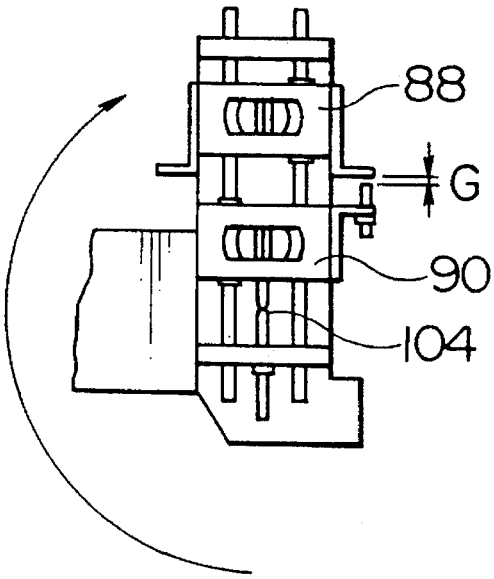
FIG. 15 is a view for use in describing the winding process performed by the automatic toroidal coil winding machine according to an embodiment of the present invention.
Figure 16:
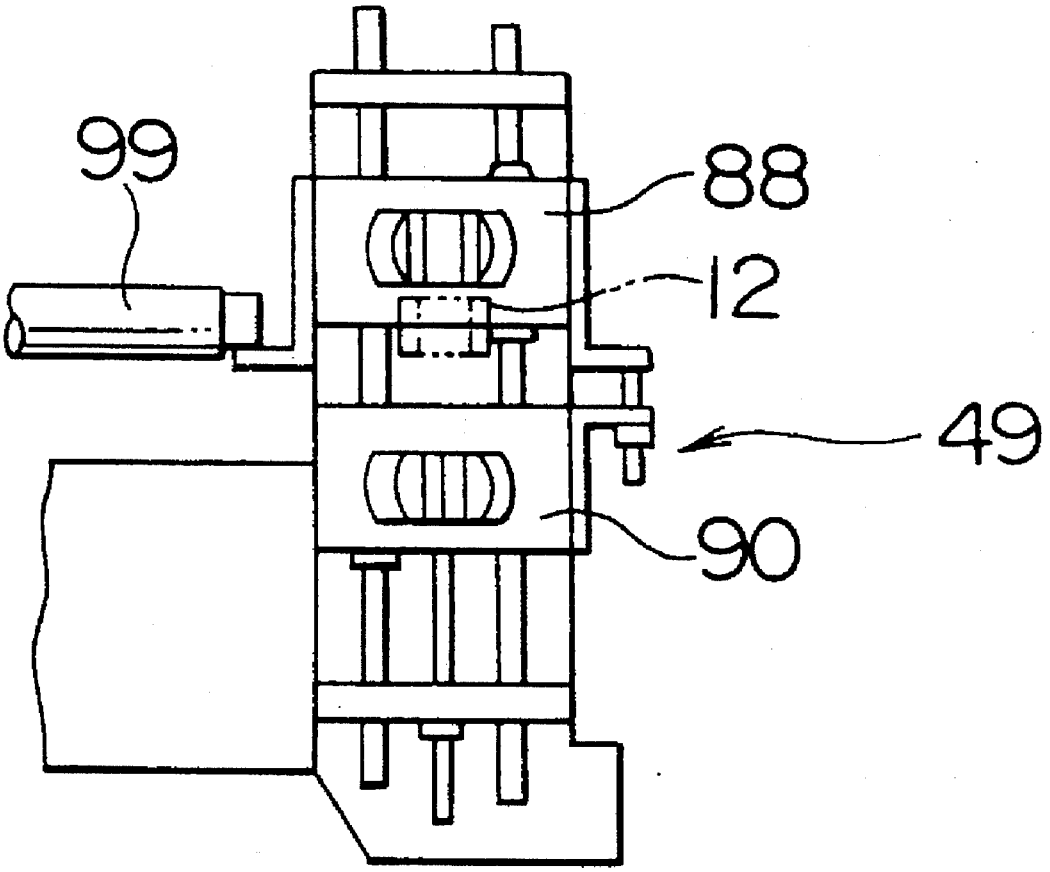
FIG. 16 is a view for use in describing the winding process performed by the automatic toroidal coil winding machine according to an embodiment of the present invention.

FIG. 14 shows the wire chuck holder 49 when downward tension is applied to the wire 18. FIG. 15 shows the wire chuck holder 49 turned upward (upward turn depicted by the arrow 136 in FIG. 9E with the leading end 20 of the wire held by the pull chuck 88 and the insertion chuck 90 spaced apart at a gap G. FIG. 16 shows a condition where the wire 18 is inserted upward into the central aperture of the core 12 by the insertion chuck 90 and the leading end 20 of the wire is pulled with no gap G just before the pull chuck 88 holds the leading end 20 (corresponding to the condition shown in FIG. 13E facing downwardly).

The wire chuck holder 49 shown in FIG. 16 is in the condition where the pull chuck 88 releases the leading end 20 of the wire after the wire chuck holder 49 rises (not shown) and is stopped just under the core 12.

The above mentioned operation makes it possible to hold by the pull chuck 88 the position of the wire shifted towards the leading end 20 (towards the insertion chuck 90) by an amount equal to a gap G at every time when the leading end 20 of the wire is inserted upwardly or downwardly into the central aperture of the core 12 and held again by the pull chuck 88. In the automatic toroidal coil winding machine according to the above mentioned second embodiment of the present invention, the position of the leading end held by the chuck is shifted by a predetermined amount at every time of re-holding during the repeated process of turning the core, turning the leading end of the wire and insertion of the same into the central aperture of the core. As a result, the position of the wire deformed due to turning is shifted gradually and the work hardening responsible for wire deformation is substantially avoided. Accordingly, it is possible to manufacture toroidal coils in high yields with no fear of wire breakage upon winding the wire on the core.

Figure 17:
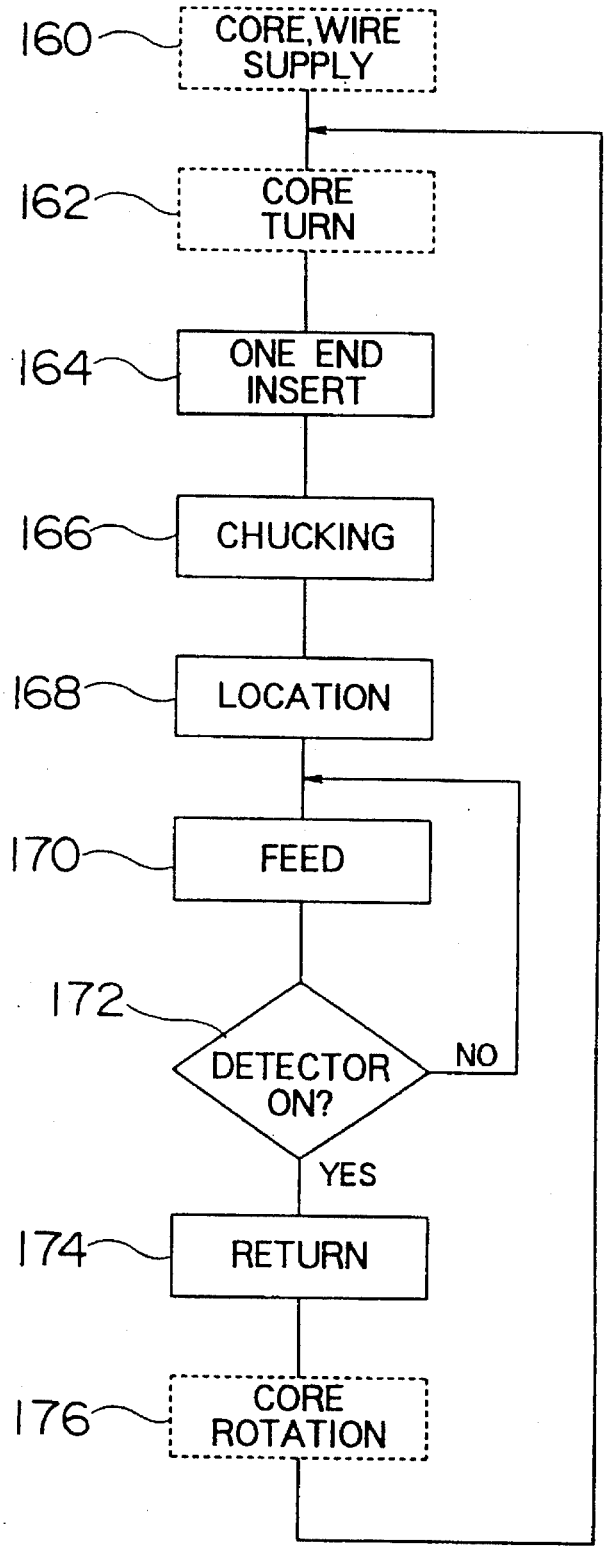
FIG. 17 is a flow chart for use in describing the winding process performed by the automatic toroidal coil winding machine according to an embodiment of the present invention, laying emphasis on a method for controlling tension applied to the wire.

Next, described with reference to FIGS. 17 and 18 are a method and a device for controlling the tension applied to the wire in an automatic toroidal coil winding machine of the upright type using a technique of turning the core according to the embodiment of the present invention. In the above mentioned toroidal coil winding machine using the technique of core turning, the efficiency of winding can be improved with the reduced cycle time of winding by means of increasing the speed of the wire chuck holder. However, such increased speed of the wire chuck holder also increases the frequency of applying a dynamic tension to the wire with some trouble in applying the tension uniformly to the entire length of wire. As a result, the stress is concentrated at a weak portion or wriggled portion of the wire to cause a local extension of the wire or even a wire breakage. In addition, in the automatic winding machine of the type described, the wire is inserted into the central aperture of the core and the tension is applied to the wire by using the wire chuck assembly traveling upward and downward along the guide rail. This means that the tension applied to the wire depends on the weight of the pull chuck of the wire chuck assembly and the inertia thereof upon traveling. Accordingly, the tension applied to the wire may be fluctuated depending on the longitudinal position of the wire chuck assembly. With this respect, it is necessary to overcome these problems and control the tension applied to the wire when the wire chuck assembly is moved at a high speed to wind the wire on the core.

In the embodiment according to the present invention, as described in conjunction with FIG. 7, the synchronous belt 55 and the servo-motor 53 are used for driving the wire chuck assembly 30 having the pull chuck 88 and the insertion chuck 90 that travels upward and downward along the guide rail 32. In addition, the wire chuck holder 49 of the wire chuck assembly 30 comprises, as described in conjunction with FIG. 5, two shutter members 91 and 93 which are different in length from each other and two tension detectors 95 and 97 corresponding to the respective shutter members. The tension applied to the wire can be controlled by using these components.

FIG. 17 is a flow chart of the operation carried out by the automatic toroidal coil winding machine according to the present invention to control the tension applied to the wire upon winding the wire on the core under tension control. The operation is now described with reference to the drawing.

Figure 18A:
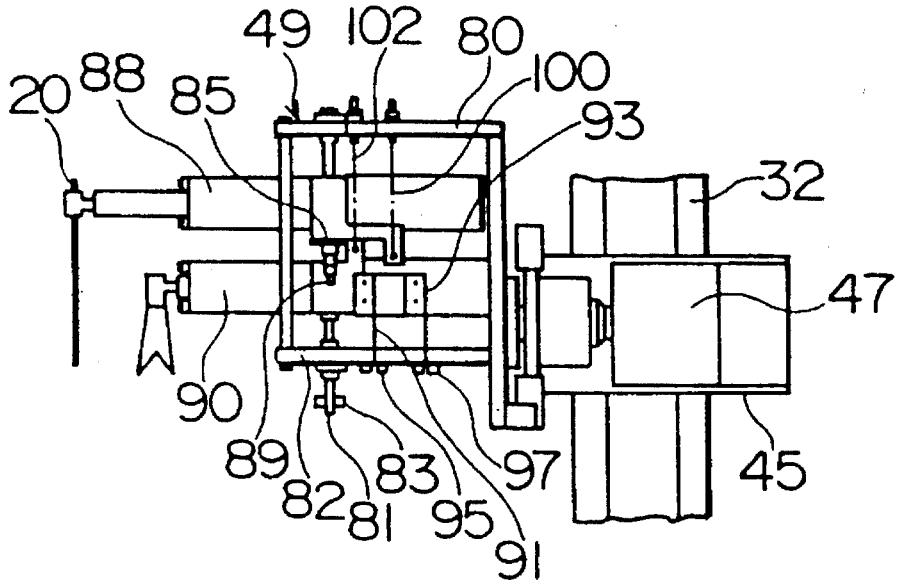
FIGS. 18A and 18B are side views of a wire chuck assembly for use in describing the automatic toroidal coil winding machine according to an embodiment of the present invention, laying emphasis is on a method for controlling tension applied to the wire.

At step 160 of core/wire feeding shown in FIG. 17, the core 12 (see FIG. 1) fed by the core/wire feeding machine 116 shown in FIG. 7 is held by the core clamp assembly 114 and the wire 18 is passed through the central aperture 22 of the core 12 by using the core/wire feeding machine 116 as described above in conjunction with FIG. 8. The wire chuck holder 49 is oriented upwardly as shown in FIG. 18A. The pull chuck 88 of the wire chuck holder 49 holds the leading end 20 of the wire and rises to a predetermined position along the guide rail 32. This predetermined distance corresponds to the length of the wire to be wound at a predetermined number of turns and is set by means of supplying predetermined number of drive pulses to the servo-motor 53. When the wire chuck holder 49 stops at the set position, the tailing end of the wire 18 is cut by the core/wire feeding machine 116 at the lower position to complete feeding of wire to the core.

At step 162 in FIG. 17 for turning the core and laying the wire on the external periphery thereof, the core 12 held by the core turning clamp 26 in the core clamp assembly 114 turns, as shown in FIGS. 2 and 9, on the rotation axis 46 together with the tailing end 24 of the wire, thereby the wire is laid on the external periphery of the core.

Figure 18B:
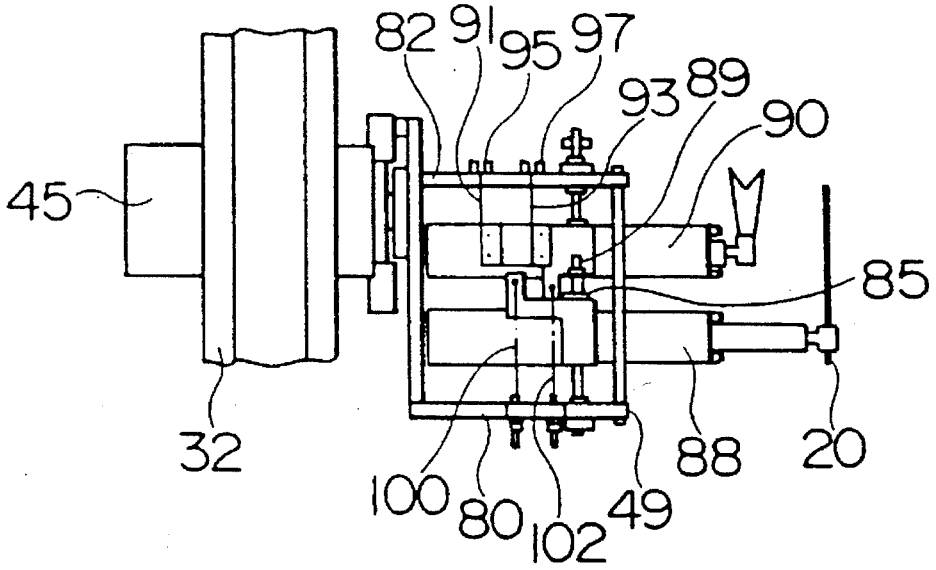

At step 164 in FIG. 17 for turning and inserting the leading end of the wire into the central aperture of the core, the wire chuck holder 49 is turned, as shown in FIG. 18B, with the pull chuck 88 holding the leading end 20 of the wire. The pull chuck turned is directed downward and is lowered to the position just above where the core 12 depicted by the dot line 105 in FIG. 7 is held. The wire chuck holder 49 represented by the solid line in FIG. 7 is in the condition where the pull chuck 88 is located at the lower stage and is on the half-way of its downward movement with the wire 18 held. Illustrated is a condition where the wire 18 is formed into a loop above the core 12 and is gradually thrown down. Subsequently, the pull chuck 88 releases the leading end 20 of the wire and the insertion chuck 90 advances to grasp the wire 18. The pull chuck 88 is then retracted towards the longitudinal guide rail 32, which is followed by the slight lowering of the wire chuck holder 49. The leading end 20 of the wire 18 held by the insertion chuck 90 is inserted into the central aperture 22 of the core.

At step 166 in FIG. 17 to close the pull chuck, the tip of the pull chuck 88 again advances towards the core to grasp the leading end 20 of the wire under the core 12. The insertion chuck 90 releases the wire 18 and is retracted back to the guide rail 32. When the pull chuck 88 grasps the leading end 20 of the wire with its tip, the stopper expanded from and retracted to the core turning clamp shown in FIG. 2 forces the pull chuck 88 to the insertion chuck 90. As a result, the gap G between them becomes zero and the position on the wire 18 held by the pull chuck 88 shifts closer to the insertion chuck by the amount equal to the gap G.

At step 168 in FIG. 17 for high-speed coarse positioning, the wire chuck holder 49 grasps the wire 18 with the pull chuck 88 and is lowered at a high speed along the longitudinal guide rail 32. The wire chuck holder 49 is lowered while stretching downward the leading end 20 of the wire. The loop of the wire is reduced in size and finally the wire is straightened. The wire chuck holder 49 stops temporarily just before the tension is applied to the straightened wire. More particularly, under this condition, the extension spring 100 connected to the pull chuck 88 shown in FIG. 18 (*b*) is not extended yet. This operation is referred to as the high-speed coarse positioning.

At step 170 in FIG. 17 for pulse feed, the drive pulses are supplied to the servo-motor 53 for moving the wire chuck holder 49 by an extremely short distance of, for example, 0.5 mm.

At step 172 in FIG. 17 for turning ON the tension detectors, the downward tension is gradually applied to the wire 18 by means of the continuous pulse feed. The pulses are continuously supplied to the servo-motor 53 until the long shutter member 93 reaches the lower tension detector 97 to turn ON the same. FIG. 18B shows the condition where the long shutter member 93 acts, in which the wire 18 is downwardly directed and the same tension is applied to the wire as is described in conjunction with FIG. 18A. The extension spring 100 is extended until the pull chuck 88 rises following the wire 18 and the L-shaped metal fitting 85 is abutted to the adjusting screw rod 89 to slightly raise both the pull chuck 88 and the insertion chuck 90. Assuming that the winding machine applies the constant tension to the wire 18, the actual tension applied to the wire 18 is increased due to the weight of the pull and insertion chucks 88 and 90 as compared with the condition illustrated in FIG. 18A. Accordingly, the length to be shifted by means of the pulse feed becomes short. This is because that the wire 18 is subjected to the tension equivalent to that caused by the extension spring 100 with the weight of the pull chuck 88 and the insertion chuck 90.

At step 174 in FIG. 17 for returning, the wire chuck holder 49 rises at a predetermined amount to release the tension to the wire after completion of the pulse feed. This operation is referred to as "return."

At step 176 in FIG. 17 for rotating the core, the core rotating clamp 28 moves along the circular rail 39 as shown in FIG. 2 to shift the horizontal position of the core by the amount equal to one pitch of winding.

Subsequently, step 162 is again carried out to turning the core and laying the wire on the external periphery of the core. As shown in FIGS. 2 and 9D, the core turning clamp 26 in the core clamp assembly 114 turns the core 12 on the rotation axis 46 to wind the wire thereon.

At the subsequent step 164 for turning and inserting the leading end of the wire into the central aperture of the core, the wire chuck holder 49 is turned, as shown in FIG. 9E, with the pull chuck 88 holding the leading end 20 of the wire. The pull chuck turned is directed upward and rises at a high speed along the guide rail 32. The pull chuck 88 moves up to and stopped at the position just under where the core 12 depicted by the dot line 105 in FIG. 7 is held. Subsequently, the pull chuck 88 releases the leading end 20 of the wire to draw it backward and the insertion chuck 90 advances to grasp the wire 18. The wire 18 held by the insertion chuck 90 slightly rises with the wire chuck holder 49 and the leading end 20 of the wire 18 is inserted from the downward into the central aperture 22 of the core.

At step 166 in FIG. 17 to close the pull chuck, the pull chuck 88 grasps the leading end 20 of the wire above the core 12. The insertion chuck 90 releases the leading end 20 of the wire 18 and is retracted backward. When the tip of the pull chuck 88 grasps the leading end 20 of the wire, the stopper expanded from and retracted to the core turning clamp shown in FIG. 2 forces the pull chuck 88 to the insertion chuck 90. As a result, the gap G between them becomes zero and the position on the wire 18 held by the pull chuck 88 shifts closer to the insertion chuck by the amount equal to the gap G.

At step 168 in FIG. 17 for high-speed coarse positioning, the wire chuck holder 49 rises at a high speed and the high-speed coarse positioning is achieved with the servo-motor 53.

At step 170 for pulse feed and at step 172 for turning ON the tension detectors, the pulses are continuously supplied to the servo-motor 53 and the upward tension is gradually applied to the wire 18 until the short shutter member 91 turns ON the first detector 95 shown in FIG. 18. In this event, the wire 18 is subjected to the tension equivalent to that caused by the extension spring 100 from which the weight of the pull chuck 88 and the insertion chuck 90 is subtracted. It is noted that, upon raising the wire chuck holder 49, the long shutter member 93 and the second detector 97 opposite to the long shutter member 93 are prevented from being operated.

At step 174 in FIG. 17 for returning, the wire chuck holder 49 performs the returning operation simultaneously with the downward stretching. Subsequently, the above mentioned steps are repeated for rotating the leading end, shifting the horizontal position of the core, and insertion the wire into the central aperture of the core.

It is possible to improve the accuracy of the high-speed coarse positioning and the tension applied to the wire by means of controlling the servo-motor 53 using a program including a data representing the length of the wire per turn (length of the wire laid on the internal periphery of the core plus that laid on the external periphery thereof) and of reducing an operational distance required for the high-speed coarse positioning in proportion to the number of turns wound on the core. In this event, the first high-speed coarse positioning is counted as the first winding or turn and then the number of turns is counted at every time when the first and the second detectors 95 and 97 generate an ON signal.

When the ON signal at the desired count is supplied to complete the return operation, the core clamp assembly 114 releases the core 12 and is lowered with the pull chuck 88 of the wire chuck holder 49 grasping the leading end 20 of the wire. If the winding operation to the core 12 is completed with the pull chuck in the down-facing orientation, the wire chuck holder 49 turns upon being lowered. The wire chuck holder 49 is then abutted to the original position sensor 125 as depicted by the broken line beneath the movable rack 112 in FIG. 7 to fall the core 12 already wound with the wire into a discharger 126.

While the above mentioned description has not referred to the extension spring 102, it is apparent that the tension applied to the wire upon raising and lowering the wire chuck holder 49 can be adjusted by means of adequately setting the gap G as well as the difference in length between the long shutter member 93 and the short shutter member 91.

In addition, while the above mentioned embodiments have thus been described in conjunction with the wire chuck holder 49 having the pull chuck 88 and the insertion chuck 90, the above mentioned method for controlling the tension can be applied to the wire chuck holder having no insertion chuck 90.

As mentioned above, according to the embodiments of the present invention, it is possible to wind the wire on the core using one extension spring in the toroidal coil winding machine of the upright type without being affected by the weight of the pull chuck. As a result, it becomes possible to provide toroidal coils having good appearance with less variation in the external dimension and in the length of the lead wire.

Furthermore, in the method and the apparatus for controlling the tension according to the embodiments of the present invention, to pull the wire and to apply the tension to the wire are made by means of operating at two stages the pull chuck for repeatedly winding the wire on the core and the wire chuck holder where the insertion chuck is implemented, which results in the reduced time for winding steps. In addition, approximately equal amount of stationary constant tension is applied to the wire and a wire-breakage preventing device is implemented for changing the position on the wire to be held by the pull chuck, so that there is no fear of trouble in winding or in the wire itself such as the breakage.

In its broad aspects, the invention resides in a method of winding a toroidal coil around a ring-shaped core having a central opening. The method comprises the steps of providing a wire of predetermined length having a first end portion and a second end portion or remaining portion extending therefrom. The wire is grasped with a wire holding chuck in a chuck-holding position and an end portion of said wire is inserted through said central opening of the core and tension applied. The wire is pulled through said opening and the core turned following which the remaining portion of the wire is turned and inserted into the central opening. The foregoing steps are repeated, wherein the chuck-holding position is shifted towards an opposite end of the wire each time an end of the wire is grasped by said chuck.

It should be understood that the present invention is not limited to the particular embodiment shown and described above, and various changes and modifications may be made without departing from the spirit and scope of the appended claims.

What is claimed is:

1. A method of winding a toroidal coil around a ring-shaped core having a central opening having a central axis, said method comprising the steps of:

(a) providing a wire of predetermined length having an end portion and a remaining portion extending therefrom;

(b) grasping said wire with a wire holding chuck in a chuck-holding position and inserting said end portion of said wire through said central opening of said core under tension, (c) pulling said wire through said opening, (d) turning said core about an axis generally orthogonal to the central axis, and (e) rotating said core about the central axis repeating steps (b) through (e).

2. A method of winding a toroidal coil around a ring-shaped core having a central opening having a central axis and characterized by a peripheral surface and an annular surface on each side of said core, said method comprising the steps of:

(a) inserting in said central opening a wire of predetermined length comprising a first end portion and a remaining portion, said first end portion being fed through said opening, contacting said remaining portion of said wire against an annular surface of said core such that said remaining portion radially extends at a predetermined length from said core, applying a tension to the wire, grasping said core by a core-turning means and turning said core in a first direction diametrically about an axis generally orthogonal to the central axis with said remaining portion of said wire, (b) inserting the first end portion of said wire into the opening of said core towards its other side, applying tension to said wire, rotating said core at a predetermined angle about the central axis by core rotating means independent of said core turning means in a first direction about said central axis, (c) grasping said core again with said core turning means to turn said core in said first direction about an axis generally orthogonal to the central axis; inserting the first end portion of said wire into said central opening of said core towards one side thereof, extending the first end portion of said wire under tension applied to said wire, rotating said core using said core rotating means to rotate said core back at said predetermined angle in a direction opposite to said first direction and form a layer of wound wire around said core, (d) repeating steps (a) through (c) to apply another layer of said winding to said core, (e) grasping again said core with said core turning means and turning said core in said first direction about an axis generally orthogonal to the central axis, inserting an end portion of said wire into the central opening of said ring-shaped core towards its other side, extending said first end end portion under tension applied to said wire, rotating the core at said predetermined angle by using said core rotating means in said opposite direction;

(f) grasping said core again with said core turning means to turn the core in said first direction about an axis generally orthogonal to the central axis; inserting said end portion of said wire into the central opening of said core towards one side thereof, extending the said first end portion of the wire applied under tension, rotating the core using said core rotating means to rotate the core at said predetermined angle in said first direction; and (g) repeating steps (e) and (f) to form a toroidal layer of said winding.

3. A method for controlling tension applied to a wire wound on a coil-winding machine of an upright type comprising the steps of:

(a) passing an end of said wire of predetermined length having a first end portion and a remaining portion through a central opening of a ring-shaped toroidal core having a center axis by means of a wire chuck holder; said core having a peripheral surface around which the wire is wound and an annular surface on each side of said core, (b) pulling the first end portion of said wire through the central opening of said toroidal core in an axial direction of said center axis;

(c) applying a predetermined tension to the wire so as to lay the wire on the peripheral surface of said toroidal core (d) turning the toroidal core about an axis generally orthogonal to said central axis;

(e) rotating the toroidal core about said central axis;

(f) passing the first end portion through the central opening; and (g) repeating steps (b) through (f) to complete the winding of said wire around the peripheral surface of said toroidal core, wherein the tension applied to the wire is constantly controlled, the wire being wound on the core in a two-stage operation of a high-speed course positioning, including means for position detection, the high speed course position being achieved by using a servo-motor in accordance with said predetermined length of wire to be wound on the core, said position detection being achieved by employing a combination of an extension spring associated with said wire chuck holder that advances in response to pulses produced by said wire chuck holder grasping an end of said wire; the method also including the use of shutter members integrally associated with grasping means mounted on said chuck holder, said tension on said wire being monitored by tension detectors associated with said wire chuck holder in a direction opposite to said shutter members.

4. A winding machine for winding a wire of predetermined length having a first end portion and a remaining portion onto a toroidal core having a central opening and a center axis therethrough comprising, a turning clamp for holding said core together with an end of said wire, said clamp being adapted for turning the core about an axis generally orthogonal to the central axis upside-down;

a feed clamp for holding said core, said feed clamp being adapted to travel along a circular guide rail relative to the central axis of said core and for rotating the core circumferentially; and a wire chuck assembly for inserting the first end portion of said wire into the central opening of said core and for applying a predetermined tension to said wire to wind the wire onto the core;

means for turning the turning clamp about an axis generally orthogonal to the central axis; and means for rotating the feed clamp and the core about the central axis, whereby turning of the core is independent of the rotation of the core.

5. The winding machine as claimed in claim 4, wherein each of said turning clamp and said feed clamp comprises a pair of grasping means having a concave portion for receiving a peripheral portion of the core, the concave portion being formed in either one of said grasping means.

6. An apparatus for controlling tension during the winding of a wire around a toroidal core in a toroidal coil winding machine of an upright type, said core having a central opening and a central axis therein which comprises:

an upwardly extending longitudinal guide rail having a top and a bottom, a servo motor mounted at the top of said guide rail, a belt cooperatively associated with said servo motor and adapted to be driven by said motor, a core clamp assembly positioned intermediate the top and bottom of said guide rail by means of which the core is grasped and horizontally supported and means for turning the core about an axis generally orthogonal to the central axis, means for rotating said toroidal core about the central axis, means for inserting one end of a wire into the central opening of said core from above or below said core, including means for pulling said wire alternatively in an upward and downward direction, said apparatus further comprising, a wire chuck holder having a slidable pull chuck for high speed positioning with respect to the servo motor along said guide rail in an up-and-down direction;

an insertion chuck, said chuck being capable of being turned and reciprocated for alternatively pulling one end of said wire in an upwardly or downwardly direction;

an extension spring disposed to cooperatively connect said pull chuck to said wire chuck holder, two shutter members projecting from said insertion chuck at an opposite end of said extension spring and said pull chuck, the shutter members differing in length from each other, and two tension detectors connected to the shutter members disposed on said chuck holder.

* * * * *